US011679946B2

(12) United States Patent
Katafuchi

(10) Patent No.: US 11,679,946 B2
(45) Date of Patent: Jun. 20, 2023

(54) SHEET FEEDING APPARATUS

(71) Applicant: CANON KABUSHIKI KAISHA, Tokyo (JP)

(72) Inventor: Tomoki Katafuchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 17/209,563

(22) Filed: Mar. 23, 2021

(65) Prior Publication Data

US 2021/0300695 A1 Sep. 30, 2021

(30) Foreign Application Priority Data

Mar. 25, 2020 (JP) ..... JP2020-054545

(51) Int. Cl.
*B65H 1/26* (2006.01)

(52) U.S. Cl.
CPC ..... *B65H 1/266* (2013.01); *B65H 2402/32* (2013.01); *B65H 2402/53* (2013.01); *B65H 2405/114* (2013.01); *B65H 2405/324* (2013.01)

(58) Field of Classification Search
CPC . B65H 1/04; B65H 1/26; B65H 1/266; B65H 2402/53; B65H 2405/10; B65H 2405/114; B65H 2405/32; B65H 2405/324; A47B 88/473; A47B 88/477; A47B 88/57; A47B 2210/0018
See application file for complete search history.

(56) References Cited

U.S. PATENT DOCUMENTS

| | | | | |
|---|---|---|---|---|
| 10,289,059 | B2 * | 5/2019 | Soda | B65H 1/266 |
| 10,486,921 | B2 | 11/2019 | Wakiyama et al. | |
| 2002/0043915 | A1 * | 4/2002 | Chan | A47B 88/57 312/334.46 |
| 2008/0117482 | A1 * | 5/2008 | Kusumi | H04N 1/00525 358/498 |
| 2010/0059928 | A1 * | 3/2010 | Sugishima | B65H 1/266 271/164 |
| 2017/0174464 | A1 * | 6/2017 | Tanaka | G03G 15/6552 |
| 2017/0308029 | A1 * | 10/2017 | Soda | G03G 21/1647 |

FOREIGN PATENT DOCUMENTS

| | | | |
|---|---|---|---|
| JP | 2008-050081 | A | 3/2008 |
| JP | 2017-134334 | A | 8/2017 |
| JP | 2017-193437 | A | 10/2017 |
| JP | 2018-104140 | A | 7/2018 |
| JP | 2019-059610 | A | 4/2019 |

* cited by examiner

*Primary Examiner* — Prasad V Gokhale
(74) *Attorney, Agent, or Firm* — Venable LLP

(57) ABSTRACT

A sheet feeding apparatus includes a sheet storing tray for loading sheets, an apparatus main body to which the sheet storing tray is slidably attached, and a restriction mechanism that restricts a position of the sheet storing tray. The restriction mechanism includes an engagement portion provided in the apparatus main body and a stopper member that is provided in the sheet storing tray and engages with the engagement portion. The stopper member is configured so as to be movable in a crossing direction crossing a direction in which the sheet storing tray slides and determines a position in the crossing direction of the sheet storing tray with respect to the apparatus main body.

9 Claims, 19 Drawing Sheets

D
2
1
205
205a
210
101
E
201
207
D3
X
Y 103
204
101

205a
D4
205
101
210
E
204
201

210
201

205
G
102
101
208
205b

210
X
Y
201
H

205a
D4
D1
D2
101
103

D´
3
C´

305a
101
305
E´
309
308
301
X
Y

D´3
309
301

103
304
101

305
D4'
305a
101
304
E'
309
301

305a
101
304
309
301

305
G´
305b
H´
102
101
310

X
Y
D´4
D1
D2
103

309
301

SHEET FEEDING APPARATUS

BACKGROUND OF THE INVENTION

Field of the Invention

The present invention relates to a sheet feeding apparatus that feeds sheets to an image forming unit and the like.

Description of the Related Art

Conventional image forming apparatuses such as printers, copying machines, and facsimile machines are provided with a sheet feeding apparatus that stores and feeds a medium for forming an image. Further, there has been invented a large-sized image forming apparatus in which a large-capacity sheet feeding apparatus is provided separately from a main sheet feeding apparatus in order to feed a large quantity of sheets to the image forming apparatus.

Such sheet feeding apparatus is configured so that a sheet storing tray is slid and drawn out from an apparatus main body to be able to add sheets. The sheet storing tray is provided with a guided member slidable with respect to a guiding member provided in an apparatus main body of the sheet feeding apparatus, and the guided member is provided with a sliding member, and therefore the sheet storing stay can smoothly operate with respect to the apparatus main body (See Japanese Patent Application Publication No. 2008-50081). This configuration improves manipulativeness of the sheet storing tray. In addition, there has been invented a sheet feeding apparatus in which a stopper that restricts a slide position is provided for preventing the sheet storing tray from being detached from the apparatus main body when a user draws out the sheet storing tray (see Japanese Patent Application Publication No. 2017-134334).

SUMMARY OF THE INVENTION

However, because the sliding member recited in Japanese Patent Application Publication No. 2008-50081 and the stopper recited in Japanese Patent Application Publication No. 2017-134334 are provided separately, they become a factor of increasing costs of the apparatus. Further, in the configuration of the stopper recited in Japanese Patent Application Publication No. 2017-134334, a user is required to lift the sheet storing tray when detaching the sheet storing tray from the apparatus main body. Accordingly, in the large-capacity sheet storing tray, a large number of sheets are loaded inside the tray and the entire sheet storing tray becomes heavy, leading to lowering of workability in attachment and detachment.

One purpose of the present invention is to provide a technology that can attain improvement of attachment/detachment performance of the sheet storing tray with respect to the apparatus main body.

In order to achieve the purpose, a sheet feeding apparatus according to one embodiment of the present invention comprises:

- a sheet storing tray for loading sheets;
- an apparatus main body to which the sheet storing tray is slidably attached; and
- a restriction mechanism that restricts a position of the sheet storing tray,
- wherein the restriction mechanism includes:
- an engagement portion provided in the apparatus main body; and

- a stopper member that is provided in the sheet storing tray and engages with the engagement portion, and
- wherein the stopper member is configured so as to be movable in a crossing direction that crosses a direction in which the sheet storing tray slides and determines a position in the crossing direction of the sheet storing tray with respect to the apparatus main body.

The present invention can improve attachment/detachment performance of the sheet storing tray with respect to the apparatus main body.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments are not intended to limit the scope of the invention to the following embodiments.

First Embodiment

Figure 1:
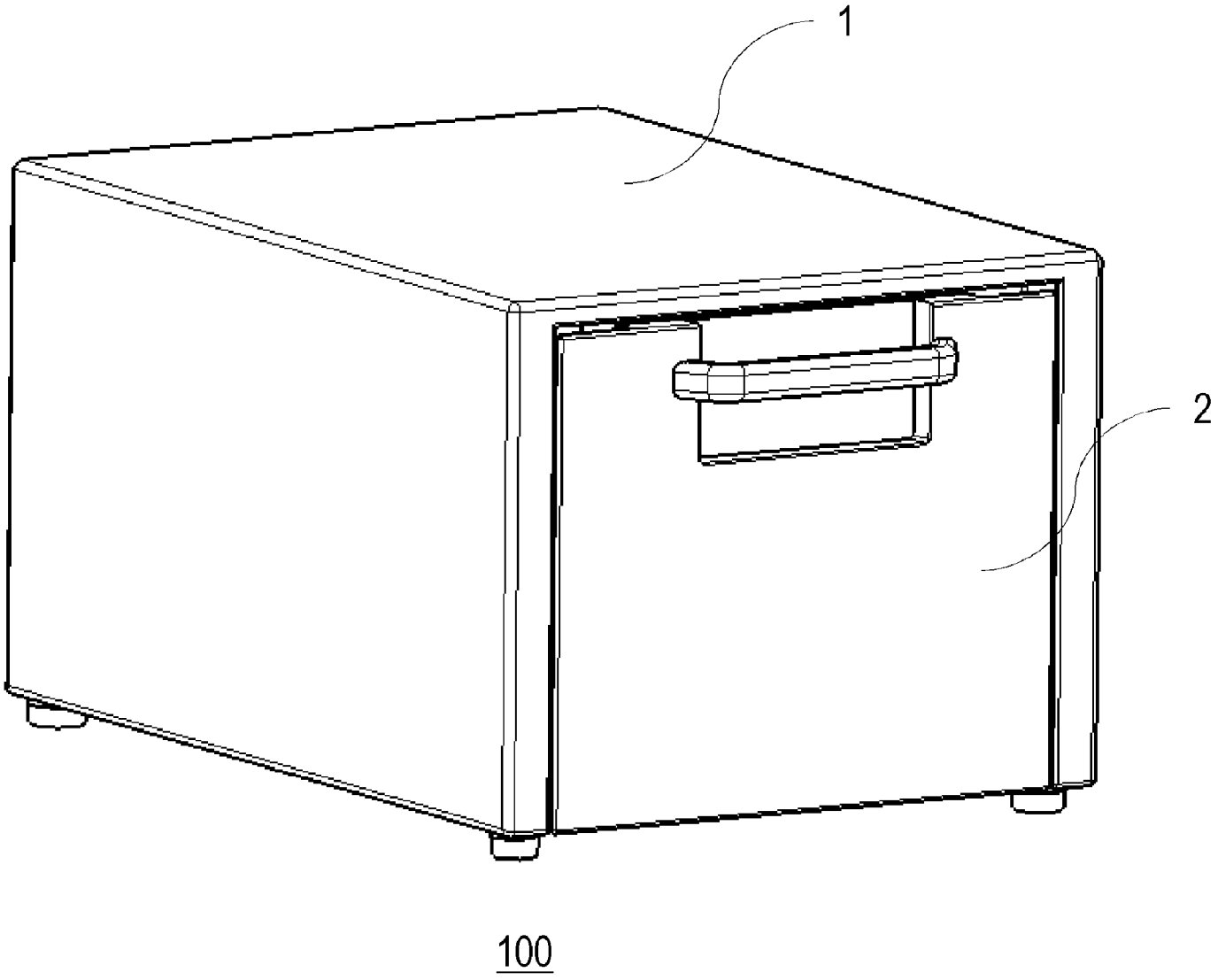
FIG. 1 is a perspective view illustrating a sheet feeding apparatus according to embodiments of the present invention alone.
Figure 2:
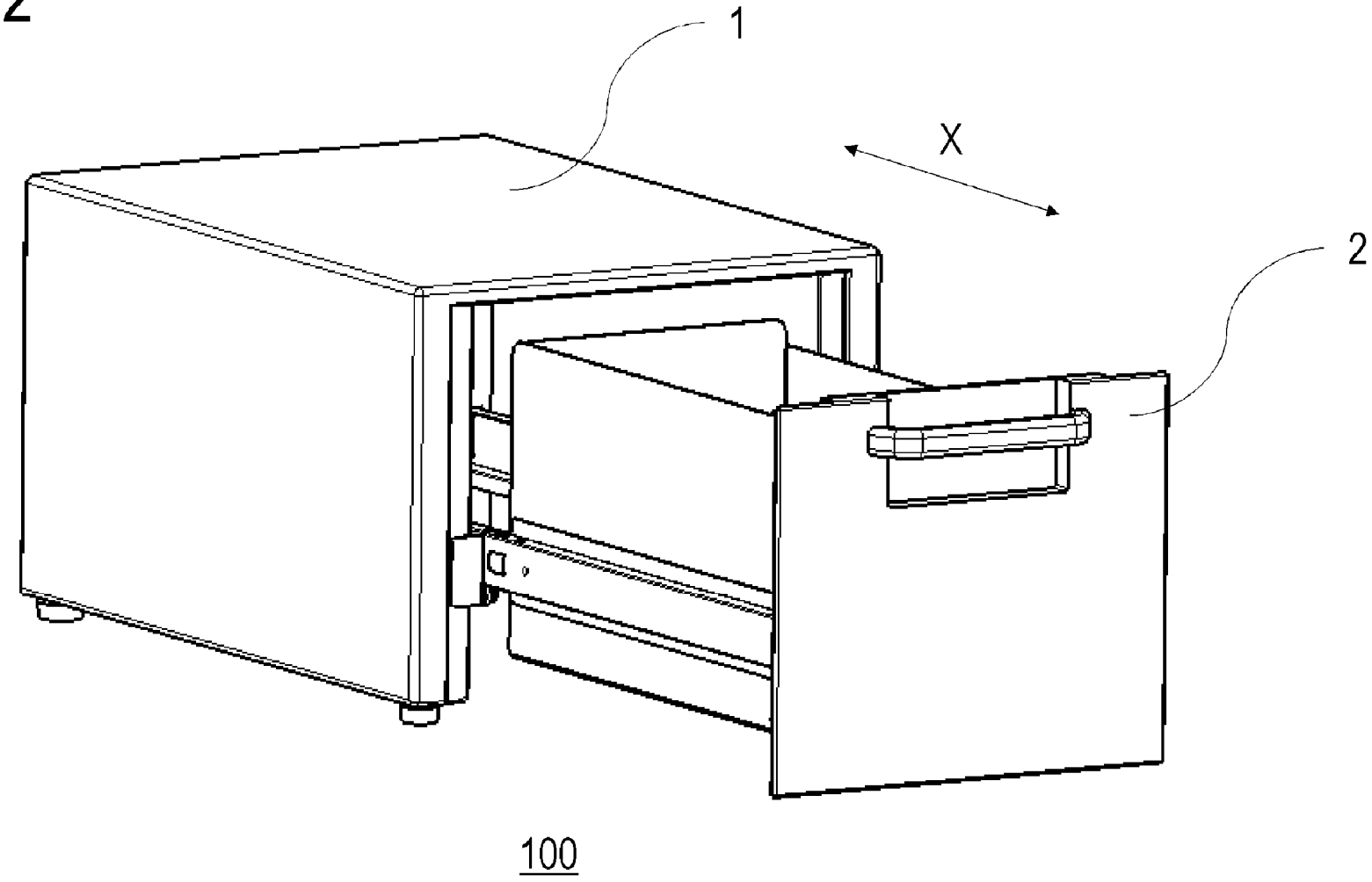
FIG. 2 is a perspective view illustrating a state in which a sheet storing tray is slid from the sheet feeding apparatus.

Description is given about a sheet feeding apparatus according to a first embodiment of the present invention to be attached to an image forming apparatus main body. FIG. 1 is a perspective view illustrating an entire sheet feeding apparatus 100. FIG. 2 is a perspective view illustrating a state in which a sheet storing tray 2 is slid from a sheet feeding apparatus main body 1. In the sheet feeding apparatus 100 according to the first embodiment, the sheet storing tray 2 that is loaded with sheets so as to feed the sheets to an image forming apparatus is provided so as to be slidable in a slide direction X.

Figure 3B:
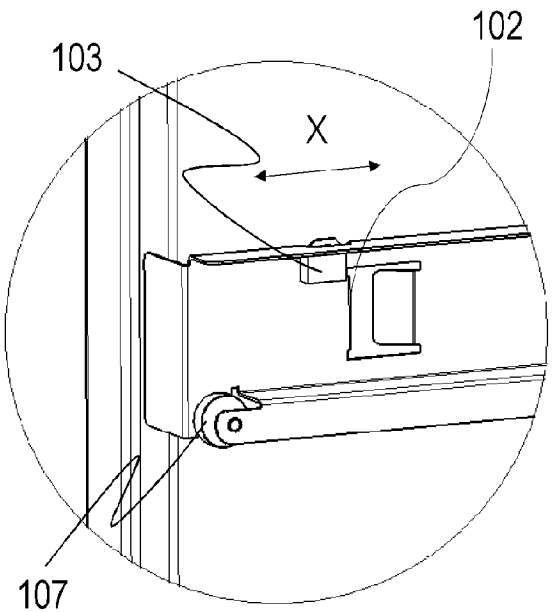
FIGS. 3A and 3B are a perspective view of the sheet feeding apparatus and a detailed view of a frame rail.
Figure 3A:
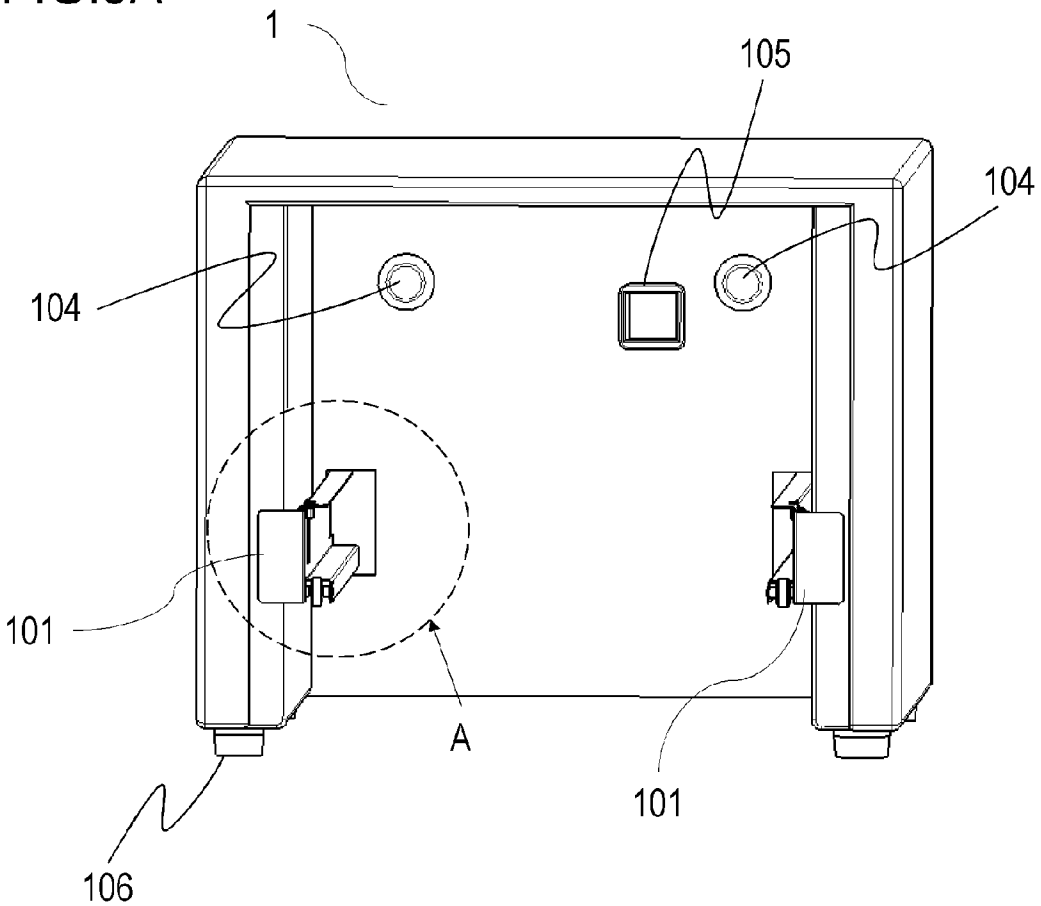

Next, description is given about detailed configuration of the sheet feeding apparatus main body 1 (hereinafter referred to as apparatus main body 1) and the sheet storing tray 2 (hereinafter referred to as tray 2). The apparatus main body 1 is described referring to FIGS. 3A and 3B. FIG. 3A is a perspective view of the apparatus main body 1, and FIG. 3B is a detailed view of an area A of a frame rail 101 shown in FIG. 3A.

The box-shaped apparatus main body 1 includes a pair of frame rails 101 for slidably drawing in and drawing out the tray 2 with respect to the apparatus main body 1 and determining a vertical position of the tray 2 with respect to the apparatus main body 1. The pair of frame rails 101 are provided so as to sandwich the tray 2 in opposed inner surfaces, respectively, in a space inside the apparatus main body 1. Attached to the frame rail 101 are a restriction portion 102 for restricting a slide position of the tray 2 shown in FIG. 3B and a frame spacer 103 and a bearing 107 that are sliding members for enabling smooth sliding of the tray 2 with respect to the apparatus main body 1.

The frame spacer 103 prevents the frame rail 101 provided in the apparatus main body 1 and a tray rail 204 (see FIG. 4 described below) provided in the tray 2 from sliding with their side surfaces directly contacting, to thereby enable smooth sliding of the tray 2. Further, the frame spacer 103 is provided in each of the pair of frame rails 101 installed so as to sandwich the tray 2 to thereby determine a clearance between the apparatus main body 1 and the tray 2 in a product width direction.

The frame spacer 103 is disposed on a product front side of the frame rail 101 (opening side of the apparatus main body 1). In a rear side surface of the apparatus main body 1, there are provided an abutting portion 104 for determining a position in the slide direction X of the tray 2 being stored in the apparatus main body 1 and a frame positioning portion 105 for determining a position in a product width direction Y. The product width direction Y is a direction orthogonal to the slide direction X and parallel to an installation surface of the sheet feeding apparatus 100. As a normally-expected installation state of the sheet feeding apparatus 100, the installation surface is the horizontal surface. In a bottom portion of the apparatus main body 1, a leg 106 is provided for supporting the main body when the apparatus main body 1 is installed on a table or a stand.

Figure 4:
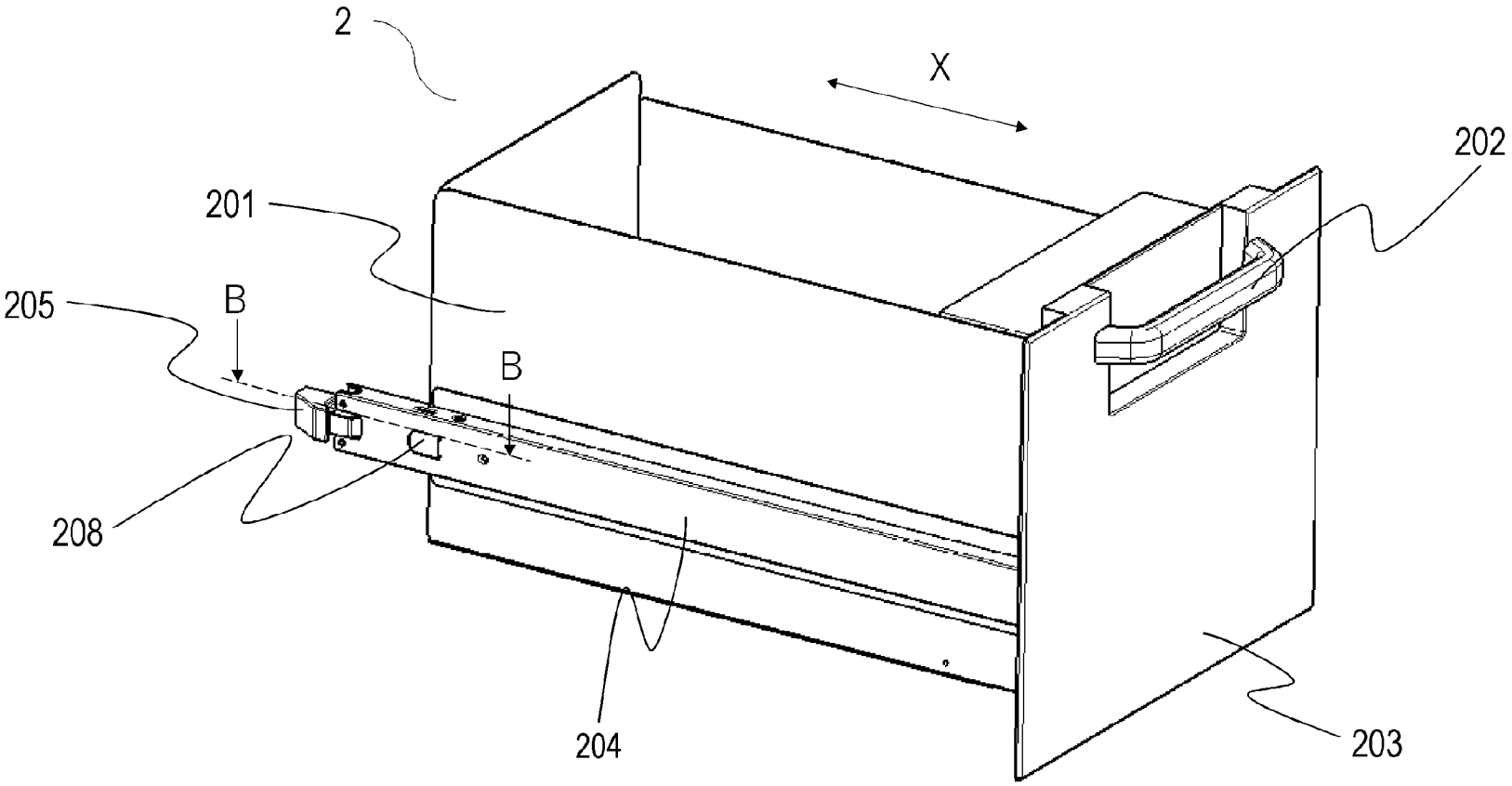
FIG. 4 is a perspective view illustrating the sheet storing tray according to a first embodiment of the present invention alone.

The tray 2 is described referring to FIG. 4. FIG. 4 is a perspective view illustrating the tray 2 alone. The tray 2 has a tray frame 201 for storing the sheets and a sheet loading plate (not shown) for loading the sheets. To the tray frame 201, a cover 203 having a handle portion 202 for drawing out the tray 2 from the apparatus main body 1 is attached. The tray frame 201 and the cover 203 are configured as a box-shaped structure having an opened upper part, and the sheets are loaded and stored inside the structure. In both side surfaces of the tray frame 201, there is provided a pair of tray rails 204 that engages with the frame rails 101 for slidably drawing in and drawing out the tray 2 with respect to the apparatus main body 1 and for determining the vertical position of the tray 2 with respect to the apparatus main body 1.

The tray rail 204 is provided with a stopper member 205 for restricting sliding in the X direction when the tray 2 is drawn out. Further, the tray rail 204 is provided with a manipulation portion 208 for enabling the user to arbitrarily cancel slide restriction of the tray 2 and allowing attachment/detachment of the tray 2 to/from the apparatus main body 1.

Figure 5:
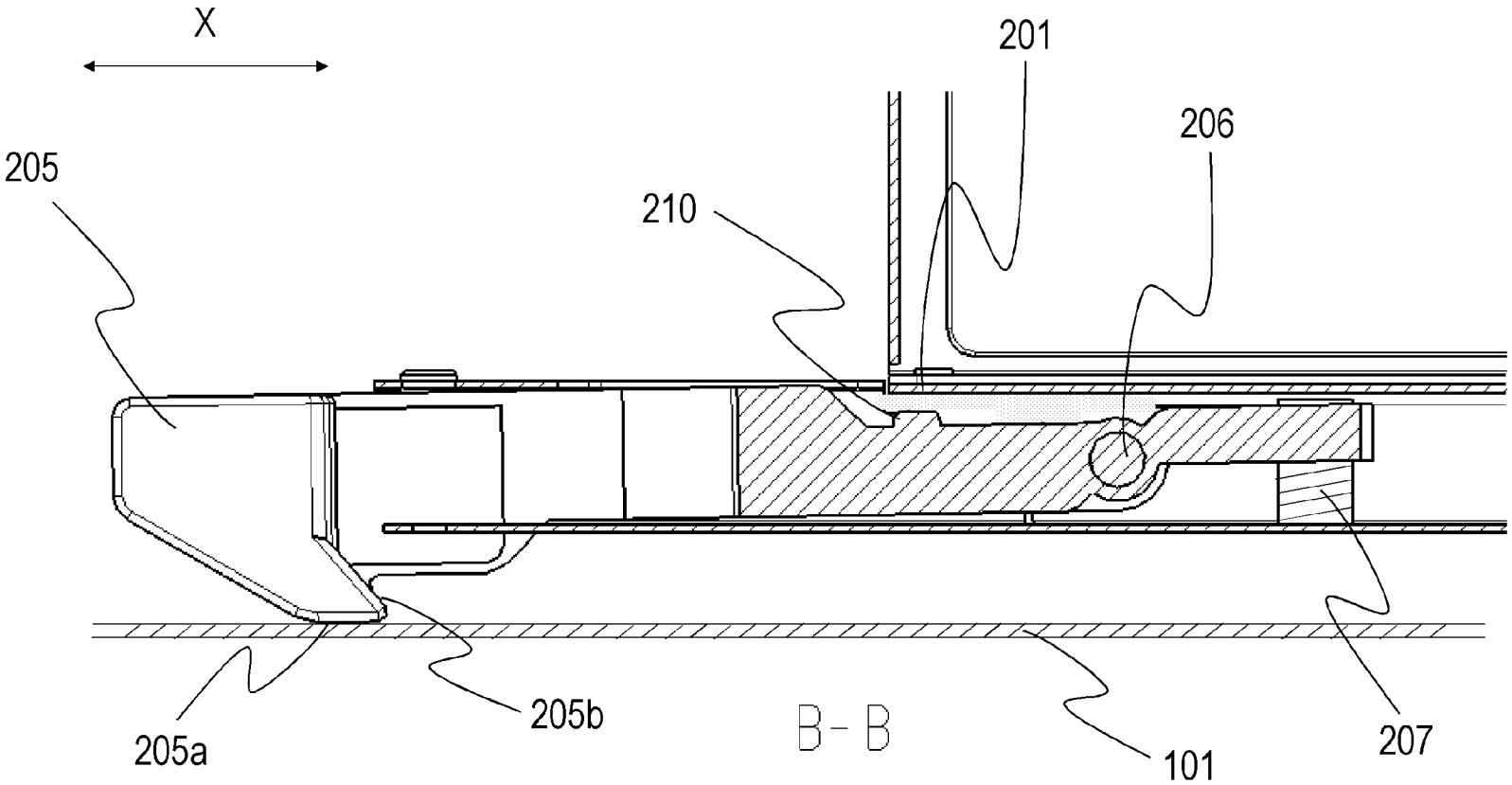
FIG. 5 is a sectional view from above taken along a line B-B in FIG. 4 of a tray rail according to the first embodiment.

Next, referring to FIG. 5, operation of the stopper member 205 is described. FIG. 5 is a sectional view taken along a line B-B of the tray rail 204 shown in FIG. 4 viewed from above (a height direction Z orthogonal to the direction X and the direction Y). The stopper member 205 provided in the tray rail 204 engages with the restriction portion 102 (see FIGS. 3A and 3B) provided in the frame rail 101 to thereby restrict sliding in a drawing-out direction. Further, the stopper member 205 is attached so as to turn about a stopper shaft 206 as a turning center, and is biased by a spring 207 as an elastic member toward the opposed frame rail 101.

The stopper member 205 is provided with a contact portion 205*a* that makes contact with the frame rail 101 when the tray 2 is sliding and a stopper portion 205*b* that engages with the restriction portion 102 (see FIGS. 3A and 3B) provided in the frame rail 101 to restrict the sliding of the tray 2. Further, a turning restriction portion 210 for restricting turning above a certain degree of the stopper member 205 is provided between the contact portion 205*a* and the stopper shaft 206, and abuts the tray frame 201 to thereby specify a turning amount of the stopper member 205.

Figure 6B:
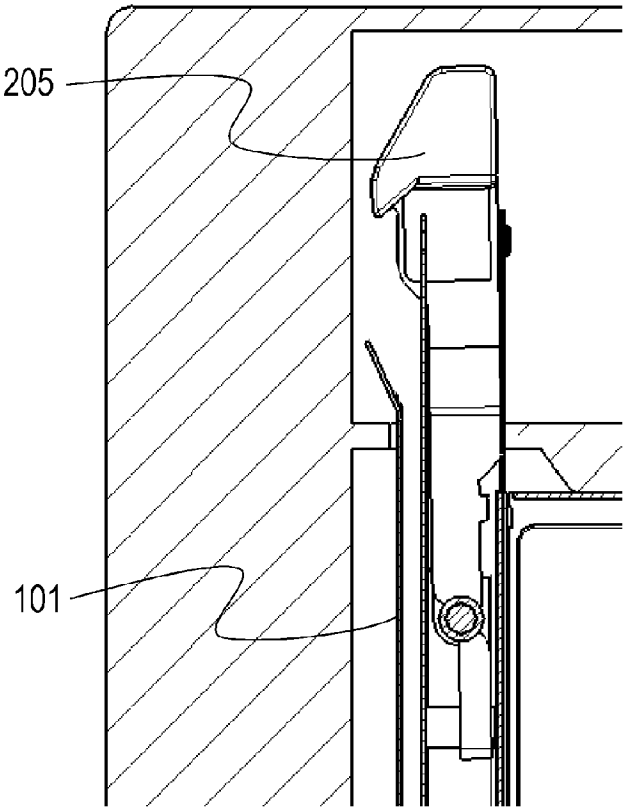
FIGS. 6A and 6B are sectional views from above illustrating a state in which the sheet storing tray according to the first embodiment is stored in the sheet feeding apparatus.
Figure 6A:
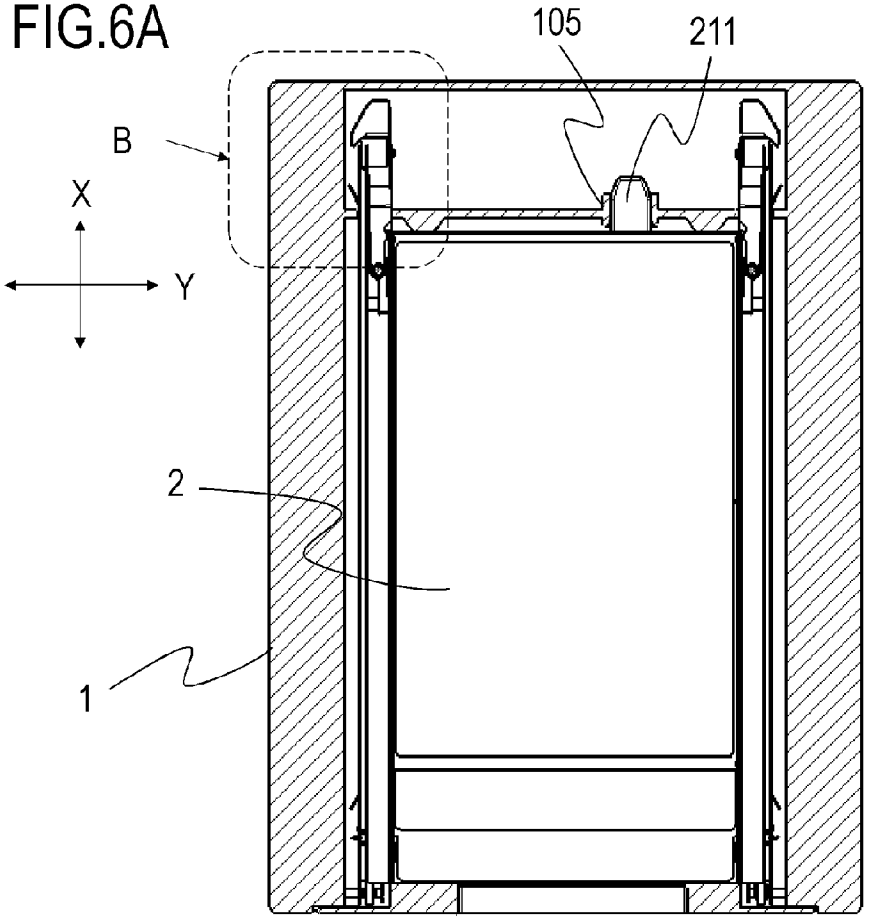

Next, operation of the stopper member 205 according to the first embodiment is described in detail referring to FIGS. 6A and 6B to FIGS. 12A and 12B. FIG. 6A is a sectional view from above illustrating a state in which the tray 2 is stored in the apparatus main body 1, and FIG. 6B is a detailed view of an area B of FIG. 6A. FIG. 7A is a sectional view from above of the tray 2 being in the middle of sliding, and FIG. 7B is a detailed view of the vicinity of the frame spacer 103 of an area C of FIG. 7A. FIG. 8A is a sectional view from above of the tray 2 being in the middle of sliding, and FIG. 8B is a detailed view of the vicinity of the stopper member 205 of an area D of FIG. 8A.

Figures 9A, 9B, 9C:
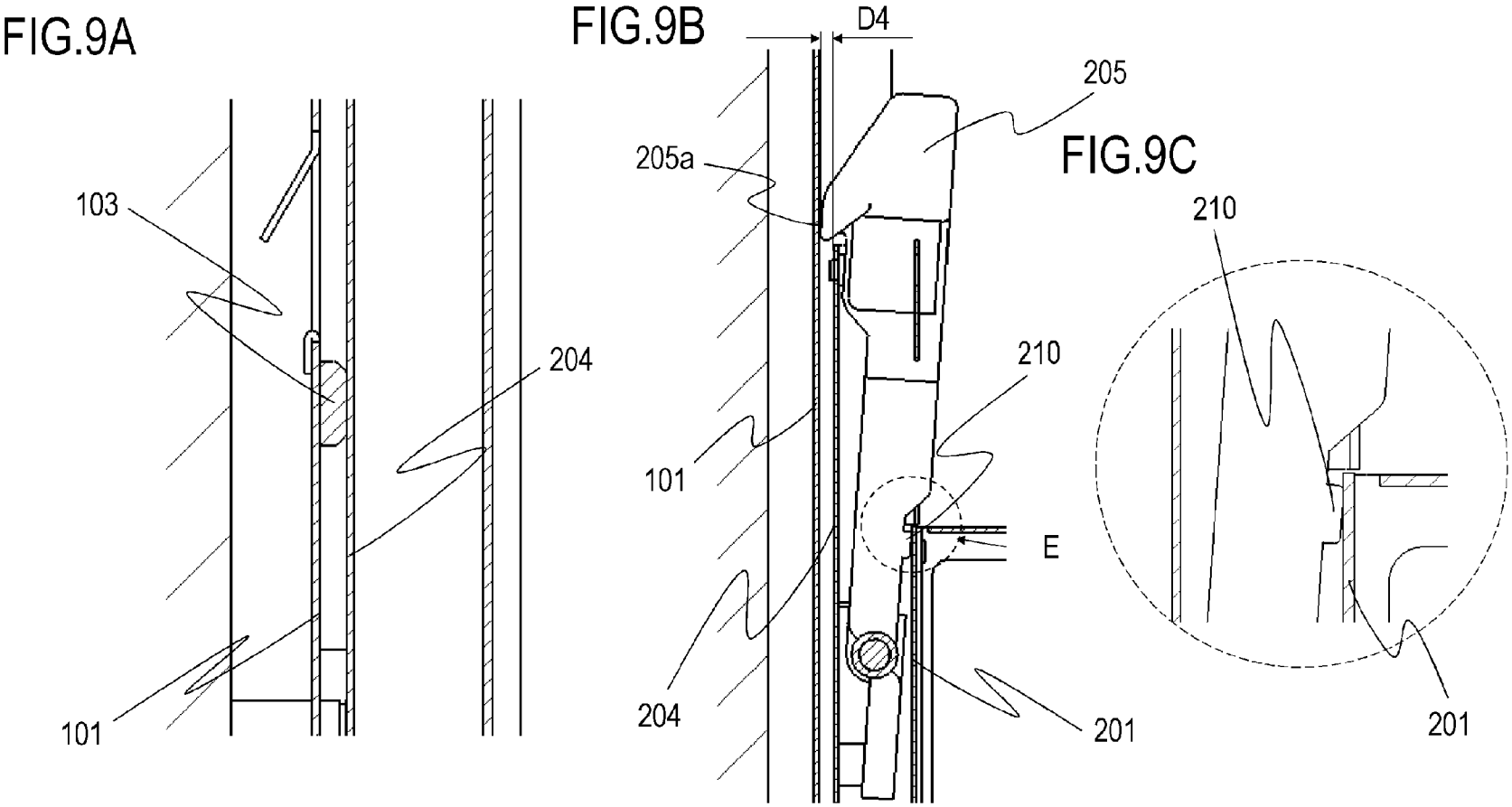
FIGS. 9A to 9C are detailed views of the frame spacer and the stopper member, in which the sheet storing tray being inclined by an amount of back lash backlash in the middle of sliding according to the first embodiment is viewed from above.
Figure 10B:
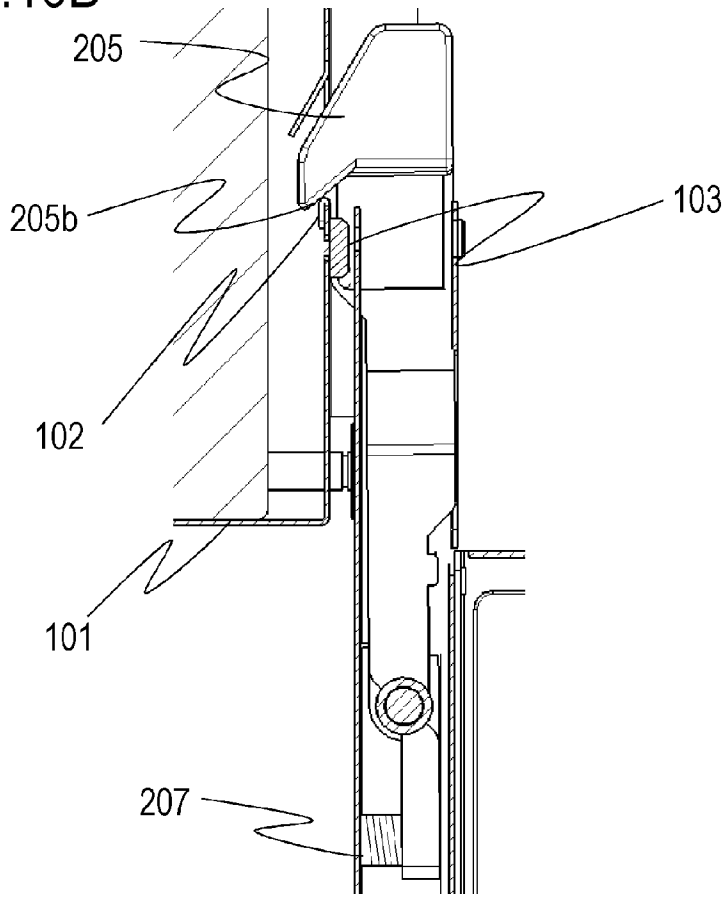
FIGS. 10A and 10B are sectional views from above of the sheet storing tray being in a slide restricting position according to the first embodiment.
Figure 10A:
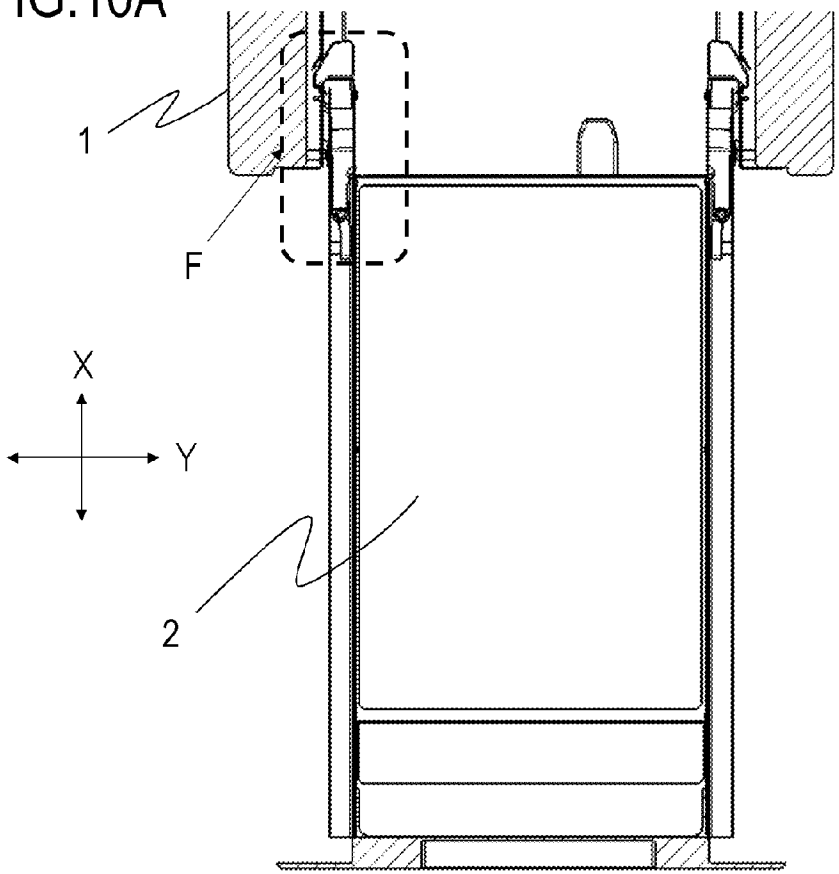

FIG. 9A is a detailed view of the vicinity of the frame spacer 103 being in the middle of sliding while the tray 2 is inclined by an amount of backlash, FIG. 9B is a detailed view of the vicinity of the stopper member 205 in the middle of sliding while the tray 2 is inclined by the amount of backlash, and FIG. 9C is a detailed view of an area E of FIG. 9B. FIG. 10A is a sectional view from above of the tray 2 being in the slide restricting position, and FIG. 10B is a detailed view of an area F shown in FIG. 10A.

Figures 11A, 11B, 11C:
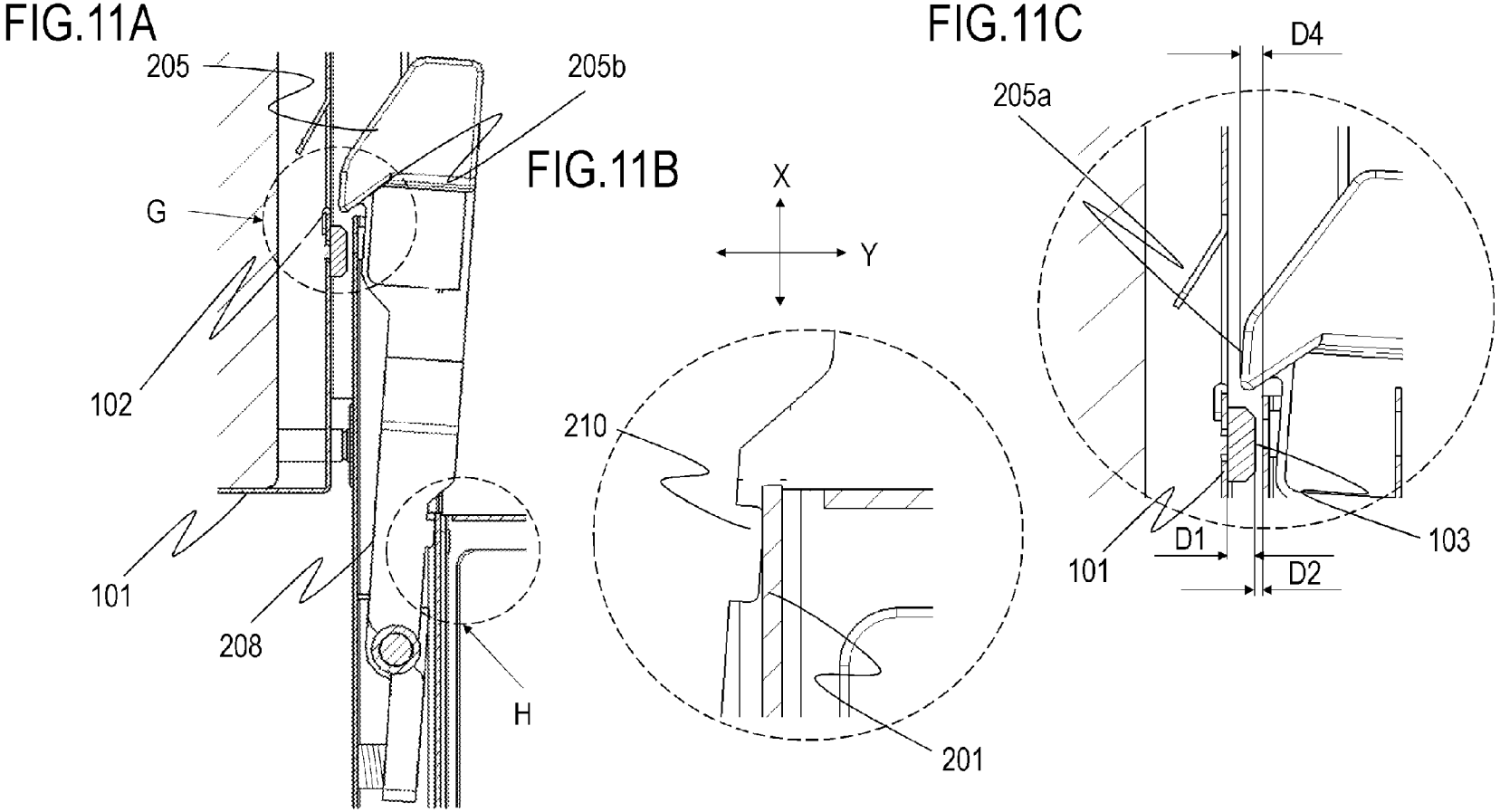
FIGS. 11A to 11C are sectional views illustrating a state in which a slide-restricted state is canceled by a user manipulation according to the first embodiment.
Figure 12B:
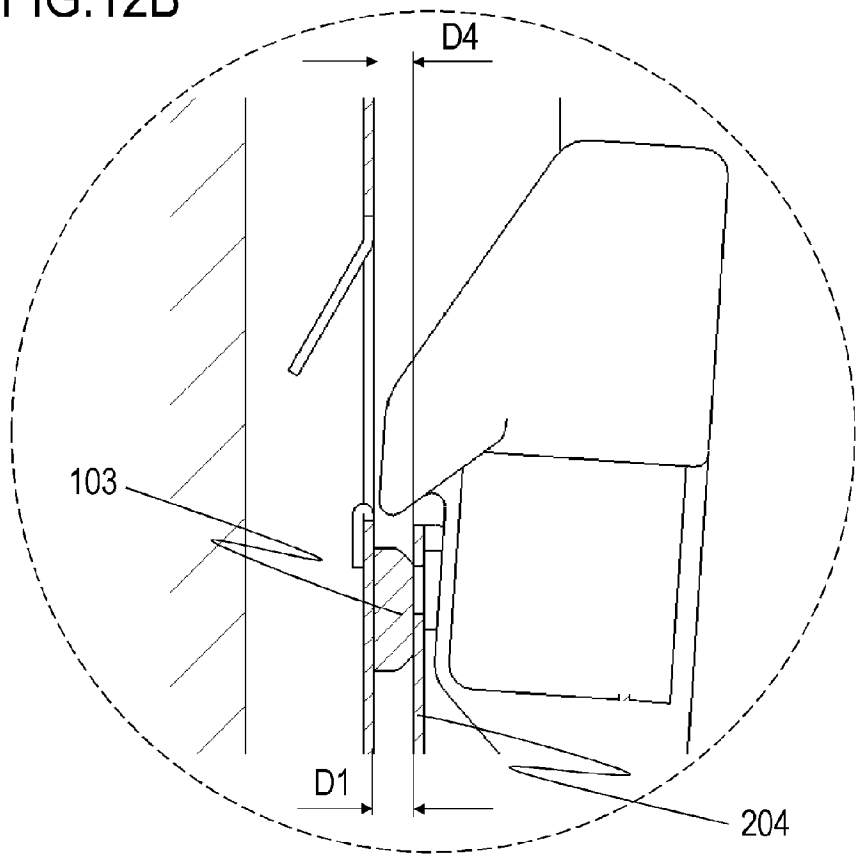
FIGS. 12A and 12B are sectional views illustrating a state in which the slide-restricted state is canceled by the user manipulation according to the first embodiment.
Figure 12A:
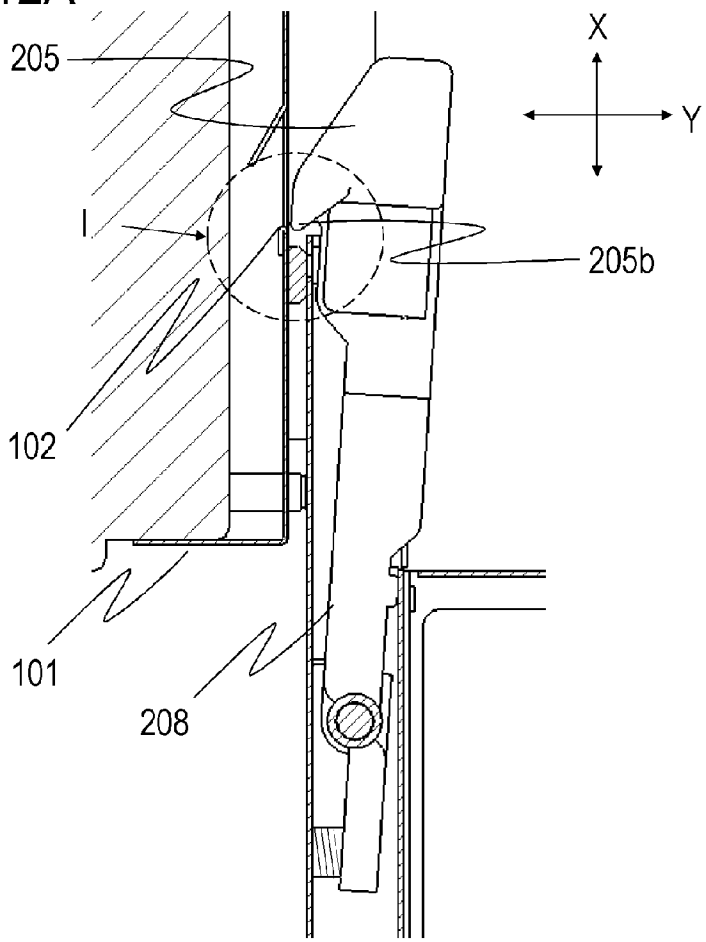

FIG. 11A is a sectional view illustrating a state in which the slide-restricted state is canceled by a user manipulation, FIG. 11B is a detailed view of an area H shown in FIG. 11A, and FIG. 11C is a detailed view of an area G shown in FIG. 11A. It should be noted that FIG. 11A to FIG. 11C illustrate a state in which the tray 2 is positioned at the center relative to the apparatus main body 1. FIG. 12A is a sectional view illustrating a state in which the slide-restricted state is canceled by the user manipulation, and FIG. 12B is a detailed view of an area I shown in FIG. 12A. It should be noted that FIG. 12A and FIG. 12B illustrate a state in which the tray 2 is inclined on one side with respect to the apparatus main body 1 and the frame spacer 103 and the tray rail 204 are in contact with each other.

As shown in FIG. 6A, in the state in which the tray 2 is stored in the apparatus main body 1 (completely-stored state), the frame positioning portion 105 and a tray positioning portion 211 fit each other, and a position in the product width direction Y of the tray 2 is determined with respect to the apparatus main body 1. In this state, as shown in FIG. 6B, the stopper member 205 is apart from the frame rail 101, and its position is not determined with respect to the product width direction Y.

Figure 7B:
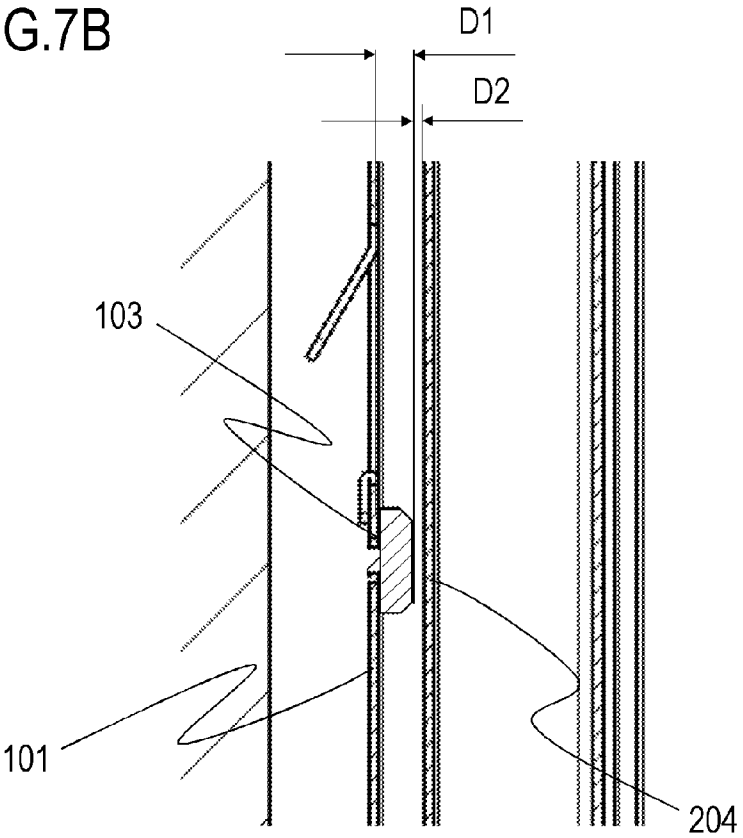
FIGS. 7A and 7B are a sectional view from above of the sheet storing tray in the middle of sliding according to the first embodiment, and a detailed view of the vicinity of a stopper member.
Figure 7A:
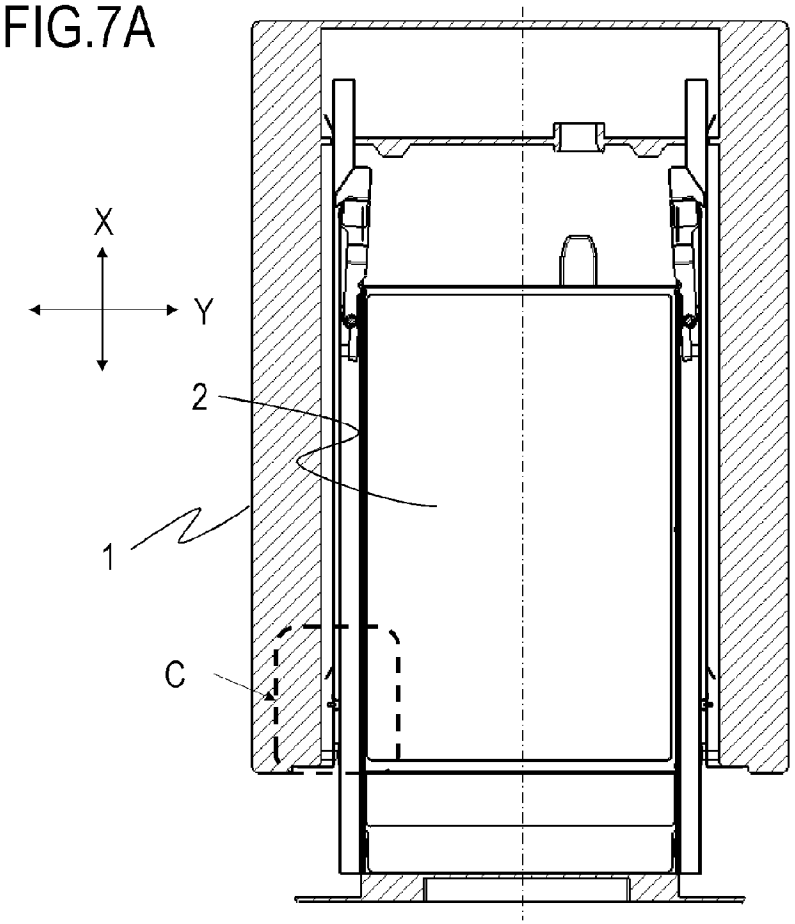

Further, as shown in FIGS. 7A and 7B and FIGS. 8A to 8C, in the state in which the tray 2 is positioned in a section between a storage position (completely-stored state shown in FIGS. 6A and 6B) and the slide restricting position (state shown in FIGS. 10A and 10B), the frame spacer 103, the tray rail 204, the stopper member 205, and the frame rail 101 determine the position in the product width direction Y of the tray 2 with respect to the apparatus main body 1. As shown in FIG. 7B, when the tray 2 is at the center of the apparatus main body 1 in the product width direction Y, a space between the frame rail 101 and the tray rail 204 in an apparatus front side (side in which the tray 2 is drawn out) corresponds to a distance obtained by adding a protruding amount D1 of the frame spacer 103 and a clearance D2 between the frame spacer 103 and the tray rail 204.

Figures 8A, 8B, 8C:
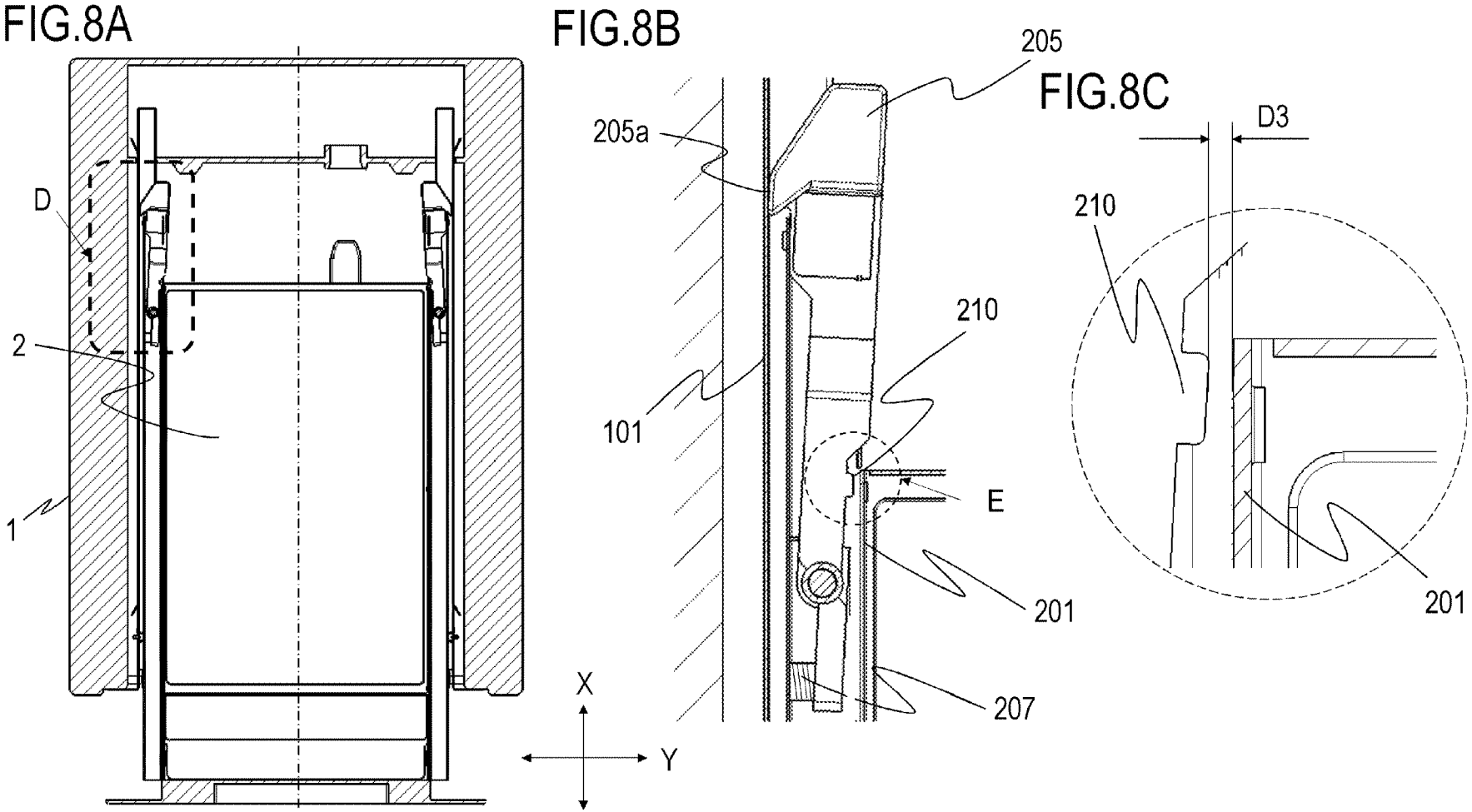
FIGS. 8A to 8C are a sectional view from above of the sheet storing tray in the middle of sliding according to the first embodiment, and detailed views of the vicinity of a frame spacer.

Further, as shown in FIG. 8B, on a rear side of the apparatus, the stopper member 205 is biased by the spring 207 to the frame rail 101. It means the contact portion 205*a* of the stopper member 205 is in contact with the frame rail 101. However, as shown in FIG. 8C, a clearance D3 is formed between the turning restriction portion 210 of the stopper member 205 and the tray frame 201.

Next, referring to FIGS. 9A to 9C, description is given to a state in which the tray 2 has been moved in the product width direction Y by the amount of the clearance D2. On the front side of the apparatus, as shown in FIG. 9A, the frame spacer 103 and the tray rail 204 make contact with each other, to thereby restrict the position in the product width direction Y of the tray 2. On the other hand, on the rear side of the apparatus, as shown in FIG. 9B and FIG. 9C, when the stopper member 205 is applied with a force larger than a biasing force by the spring 207, the stopper member 205 turns by the amount of the clearance D3 (see FIG. 8C) and the turning restriction portion 210 abuts the tray frame 201. At this time, the contact portion 205*a* of the stopper member 205 is protruded from the tray rail 204 by the amount of D4.

As a result, without contact of the tray rail 204 with the frame rail 101, the stopper member 205 determines the position in the product width direction Y, which means the stopper member 205 plays a role of the spacer member. At this time, the protruding amount D4 of the contact portion 205*a* from the tray rail 204 is set to $D1 \geq D4$.

When the tray 2 is drawn out and moved to the slide restricting position as shown in FIG. 10A, the stopper member 205 provided in the tray 2 turns, as shown in FIG. 10B, to the restriction portion 102 provided on the side of the frame rail 101 by the biasing force of the spring 207. As a result, the restriction portion 102 and the stopper portion 205*b* engage with each other to thereby restrict sliding of the tray 2 in the drawing-out direction (slide direction X).

As shown in FIG. 11A, when the stopper member 205 is manipulated so that the stopper member 205 moves to a cancel position for detaching the tray 2 being in the slide-restricted state (see FIGS. 10A and 10B) from the apparatus main body 1, the user manipulates the manipulation portion 208 provided in the stopper member 205. The manipulation is specifically the manipulation of pushing in the manipulation portion 208 according to the first embodiment. When the manipulation portion 208 is manipulated with a force larger than a spring pressure biasing the stopper member 205, the stopper member 205 turns about the stopper shaft 206 as a rotation center, and is manipulated, as shown in FIG. 11B, until the turning restriction portion 210 abuts the tray frame 201. In the state of FIGS. 11A to 11C, there is a clearance of $D2+D1-D4 \geq 0$ between the contact portion 205*a* of the stopper member 205 and the frame rail 101 as shown in FIG. 11C. This enables the slide restriction to be canceled, and sliding the tray 2 in the slide direction X enables detachment of the tray 2 from the apparatus main body 1.

In practice, as shown in FIG. 12A, there is a case of performing detachment with the frame spacer 103 being in contact with the tray rail 204. Setting the protruding amount D1 and the protruding amount D4 to be as close values as possible makes it possible to reduce backlash between the apparatus main body 1 and the tray 2. When the frame spacer 103 and the restriction portion 102 are disposed apart from each other, the tray 2 turns about the frame spacer 103. As a result, a clearance with the tray rail 204 in the vicinity of the restriction portion 102 at a distance apart from the frame spacer 103 becomes smaller than the protruding amount D1.

To prevent this, in the configuration according to the first embodiment, as shown in FIG. 12B, the frame spacer 103 is disposed in the vicinity of the restriction portion 102 of the frame rail 101. This configuration ensures the clearance by the frame spacer 103 regardless of the posture of the tray, and therefore the tray 2 can be detached from the apparatus main body 1.

Owing to the operation described above, in the sheet feeding apparatus according to the first embodiment, the stopper member and the spacer member provided on the sheet storing tray side can be configured by the same member (stopper member 205), and therefore costs of the apparatus can be reduced. Further, because cancellation of the slide position restriction when the sheet storing tray 2 is detached from the sheet feeding apparatus main body 1 can be performed by manipulating the stopper member 205, the sheet storing tray 2 can be detached without being lifted and therefore attachment/detachment performance is improved.

Second Embodiment

Description is provided about a sheet feeding apparatus according to a second embodiment of the present invention to be attached to the image forming apparatus main body. It should be noted that description of members having the same function as those according to the first embodiment is omitted appropriately.

Figure 13:
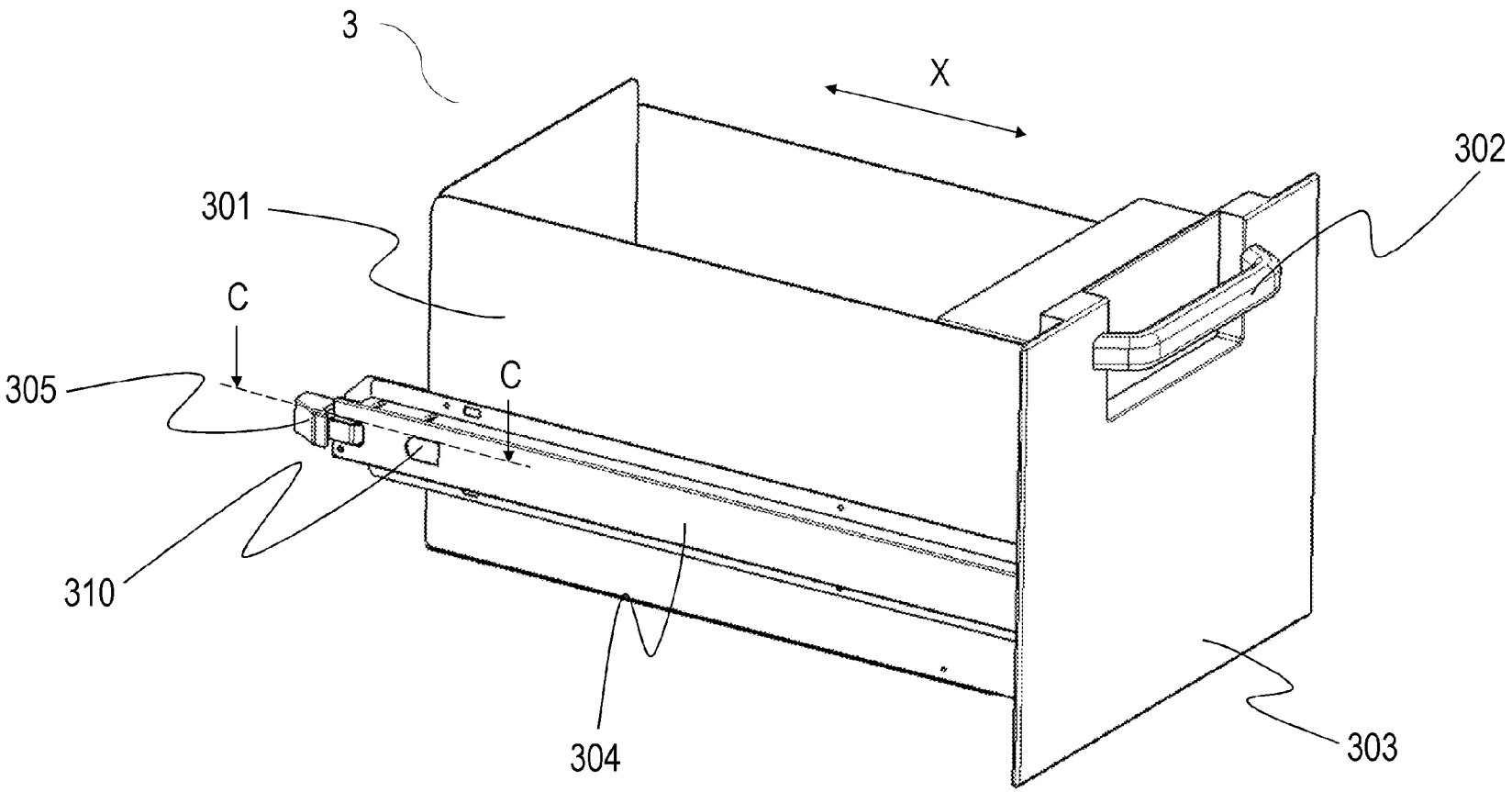
FIG. 13 is a perspective view illustrating a sheet storing tray according to a second embodiment of the present invention alone.

A sheet storing tray 3 (hereinafter referred to as tray 3) according to the second embodiment is described referring to FIG. 13 and FIG. 14. FIG. 13 is a perspective view illustrating the tray 3 alone. The tray 3 has a tray frame 301 for storing sheets, and a sheet loading plate (not shown) for loading the sheets. To the tray frame 301, a cover 303 having a handle portion 302 for drawing out the tray 3 from the apparatus main body 1 is attached. In both side surfaces of the tray frame 301, there is provided a tray rail 304 that engages with the frame rail 101 for slidably drawing in and drawing out the tray 3 with respect to the apparatus main body 1 and for determining a vertical position of the tray 3 with respect to the apparatus main body 1.

The tray rail 304 is provided with a stopper member 305 for restricting sliding in the X direction when the tray 3 is drawn out. Further, the tray rail 304 is provided with a manipulation portion 310 for enabling the user to arbitrarily cancel slide restriction of the tray 3 and allowing attachment/detachment of the tray 3 to/from the apparatus main body 1.

Figure 14:
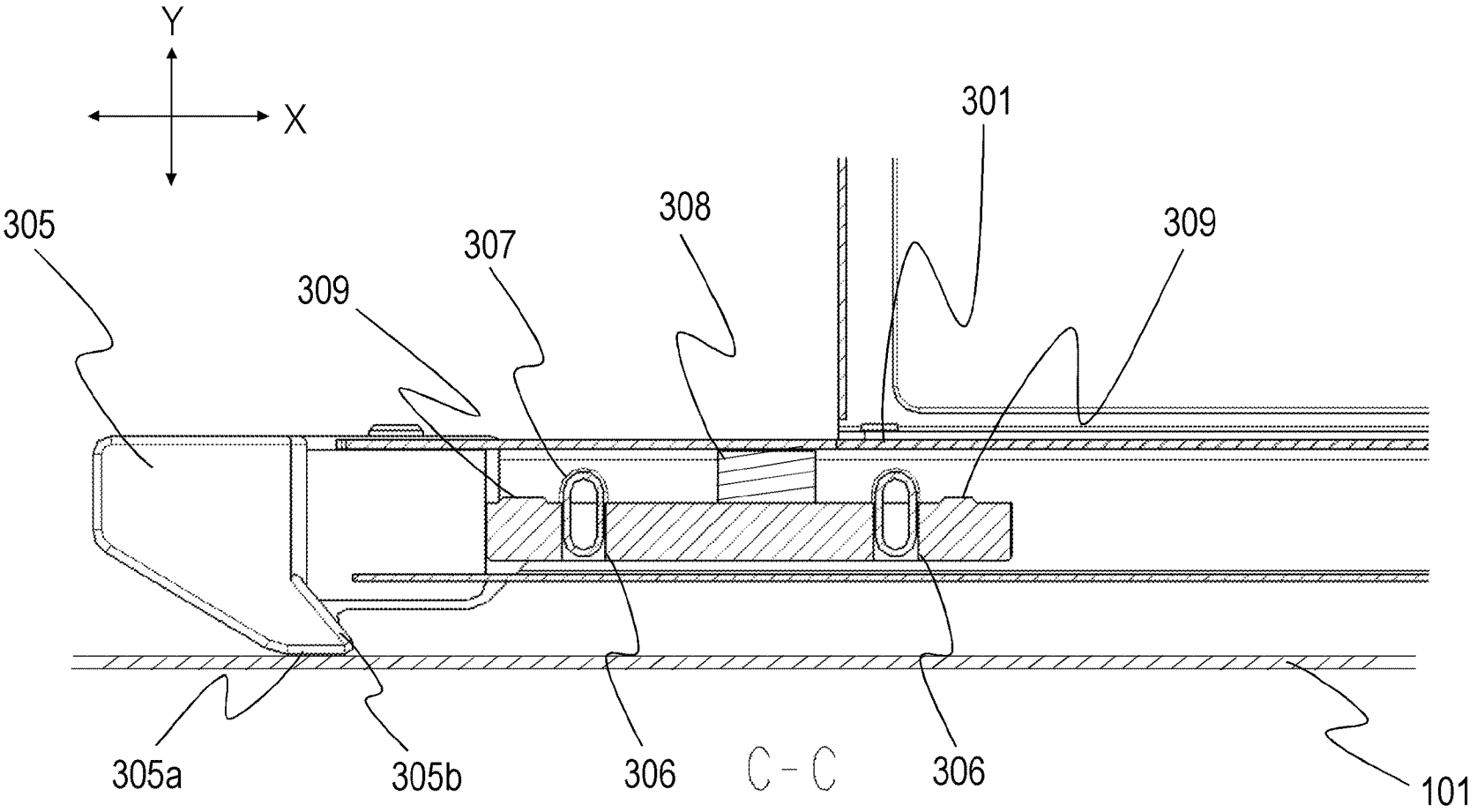
FIG. 14 is a sectional view from above taken along a line C-C in FIG. 13 of a tray rail according to the second embodiment.

Next, referring to FIG. 14, operation of the stopper member 305 is described. FIG. 14 is a sectional view from above taken along a line C-C of the tray rail 304 shown in FIG. 13. The stopper member 305 provided in the tray rail 304 engages with the restriction portion 102 (see FIGS. 3A and 3B) provided in the frame rail 101 to thereby restrict a slide position of the tray 3. Further, the stopper member 305 is attached so as to be slidable by a slide groove 306 and a slide guide 307 provided in the tray rail 304, and is biased toward the opposed frame rail 101 by the spring 308.

The stopper member 305 is provided with a contact portion 305*a* that makes contact with the frame rail 101 when the tray 3 is sliding and a stopper portion 305*b* that engages with the restriction portion 102 provided in the frame rail 101 to restrict the sliding of the tray 3. A slide restriction portion 309 for restricting sliding above a certain degree of the stopper member 305 abuts the tray frame 301 to thereby specify a sliding amount of the stopper member 305.

Figures 15A, 15B, 15C:
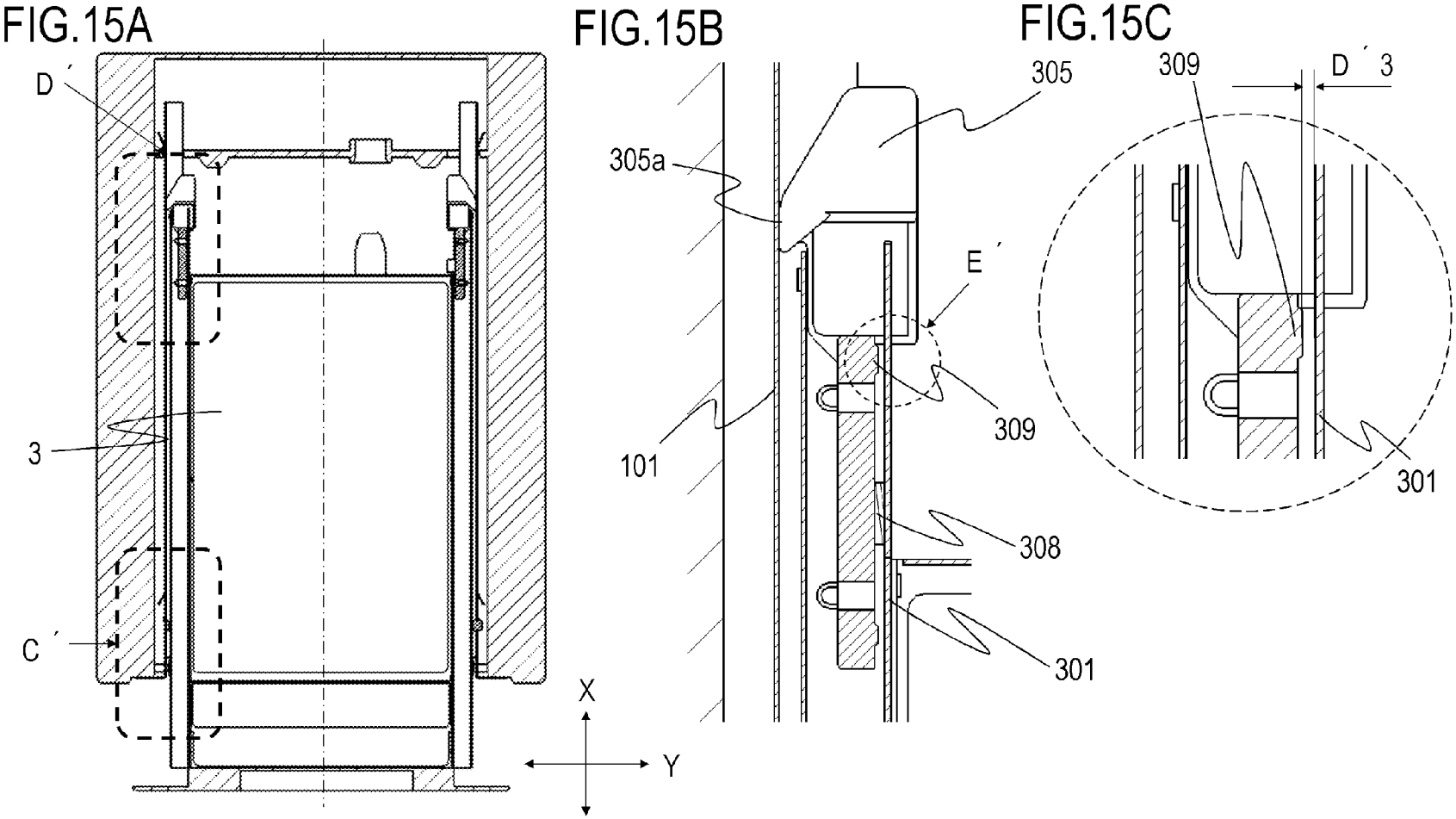
FIGS. 15A to 15C are sectional views from above of the sheet storing tray in the middle of sliding according to the second embodiment, and a detailed view of the vicinity of a stopper member.

Next, operation of the stopper member 305 according to the second embodiment is described in detail referring to FIGS. 15A to 19B. FIG. 15A is a sectional view from above of the tray 3 in the middle of sliding, FIG. 15B is a detailed view of the vicinity of the stopper member 305 of an area D' of FIG. 15A, and FIG. 15C is a detailed view of an area E' of FIG. 15B.

Figures 16A, 16B, 16C:
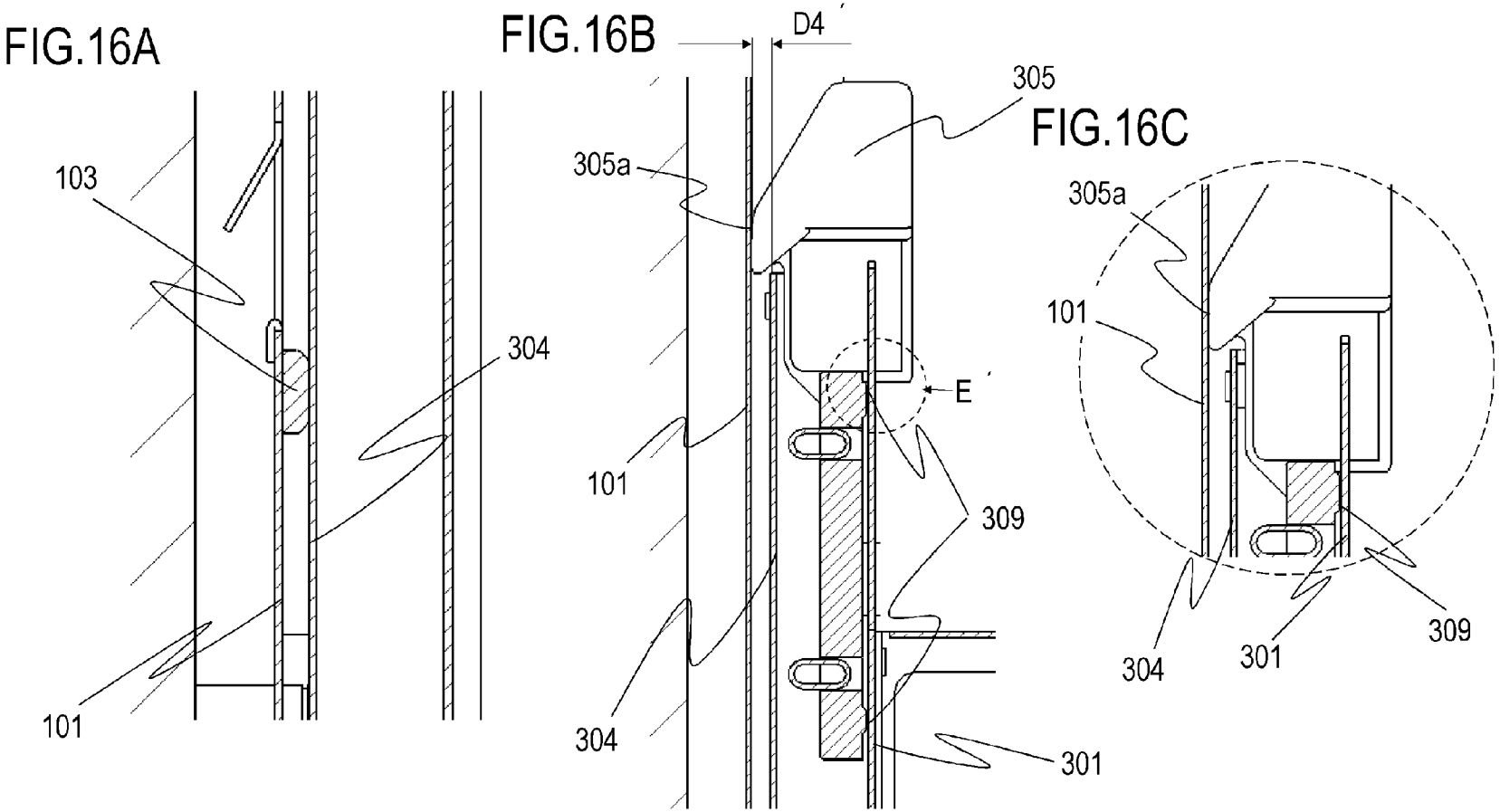
FIGS. 16A to 16C are detailed views of a frame spacer and the stopper member, in which the sheet storing tray being inclined by an amount of backlash in the middle of sliding according to the second embodiment is viewed from above.
Figure 17B:
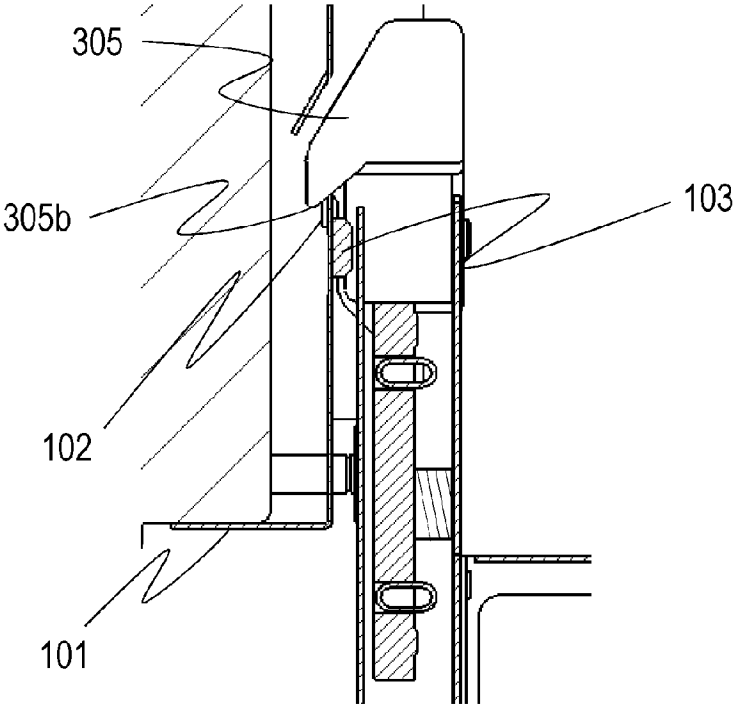
FIGS. 17A and 17B are sectional views from above of the sheet storing tray being in a slide restricting position according to the second embodiment.
Figure 17A:
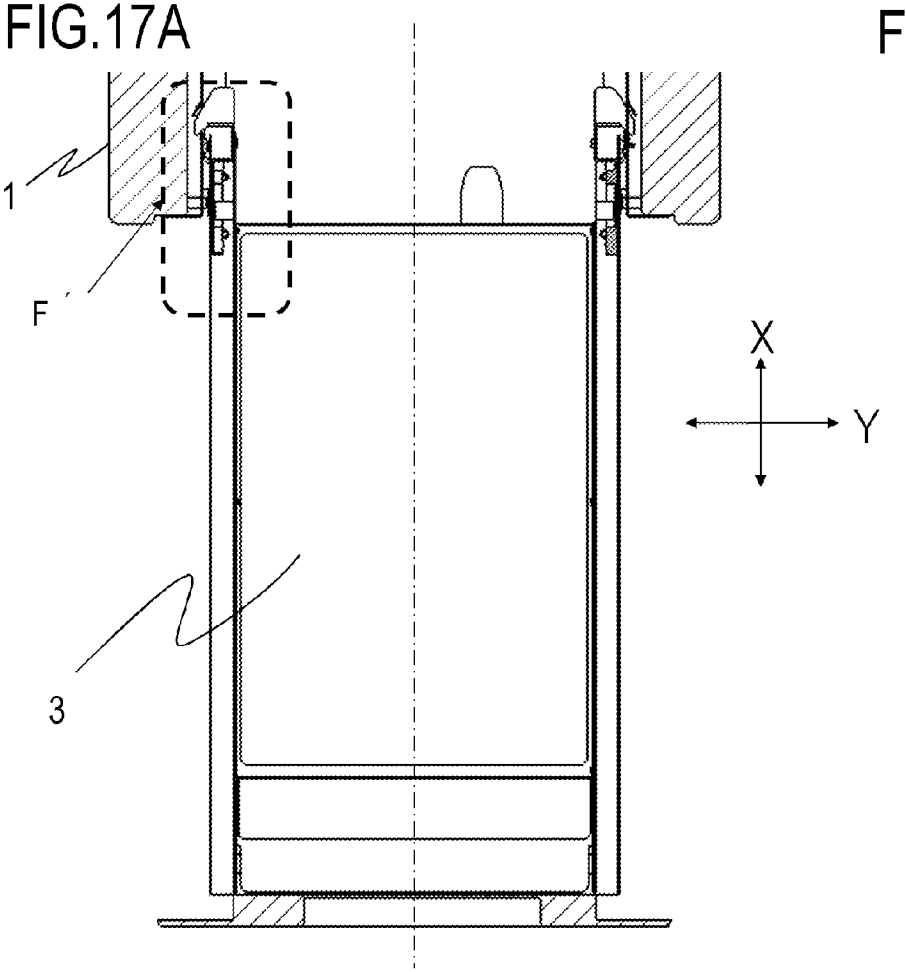

FIG. 16A is a detailed view of the vicinity of the frame spacer 103 in the middle of sliding while the tray 3 is inclined by an amount of backlash, FIG. 16B is a detailed view of the vicinity of the stopper member 205 in the middle of sliding while the tray 3 is inclined by the amount of backlash, and FIG. 16C is a detailed view of the area E' of FIG. 16B. FIG. 17A is a sectional view from above of the tray 3 in the slide restricting position, and FIG. 17B is a detailed view of an area F' shown in FIG. 17A.

Figures 18A, 18B, 18C:
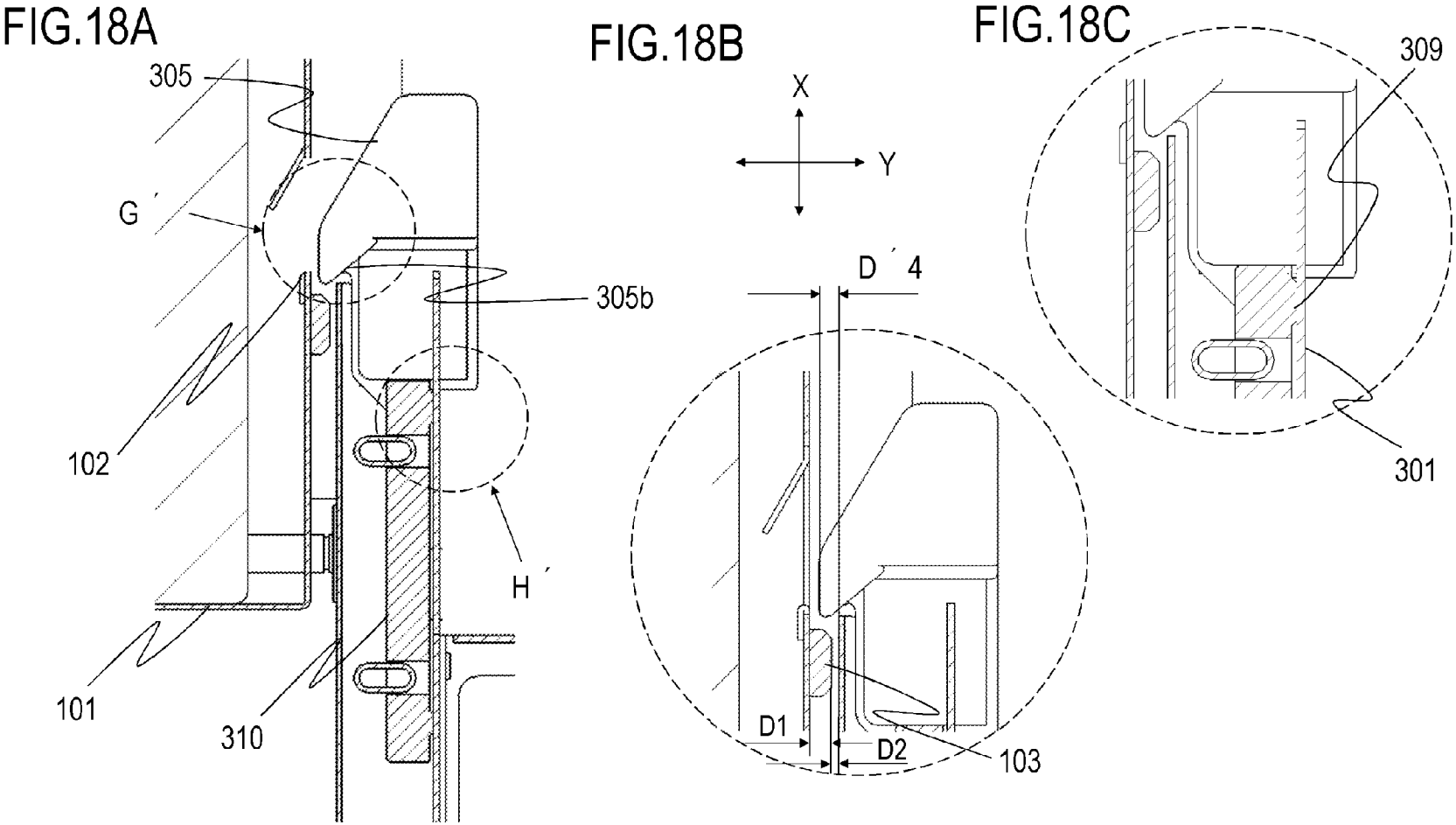
FIGS. 18A to 18C are sectional views illustrating a state in which a slide-restricted state is canceled by a user manipulation according to the second embodiment.
Figure 19B:
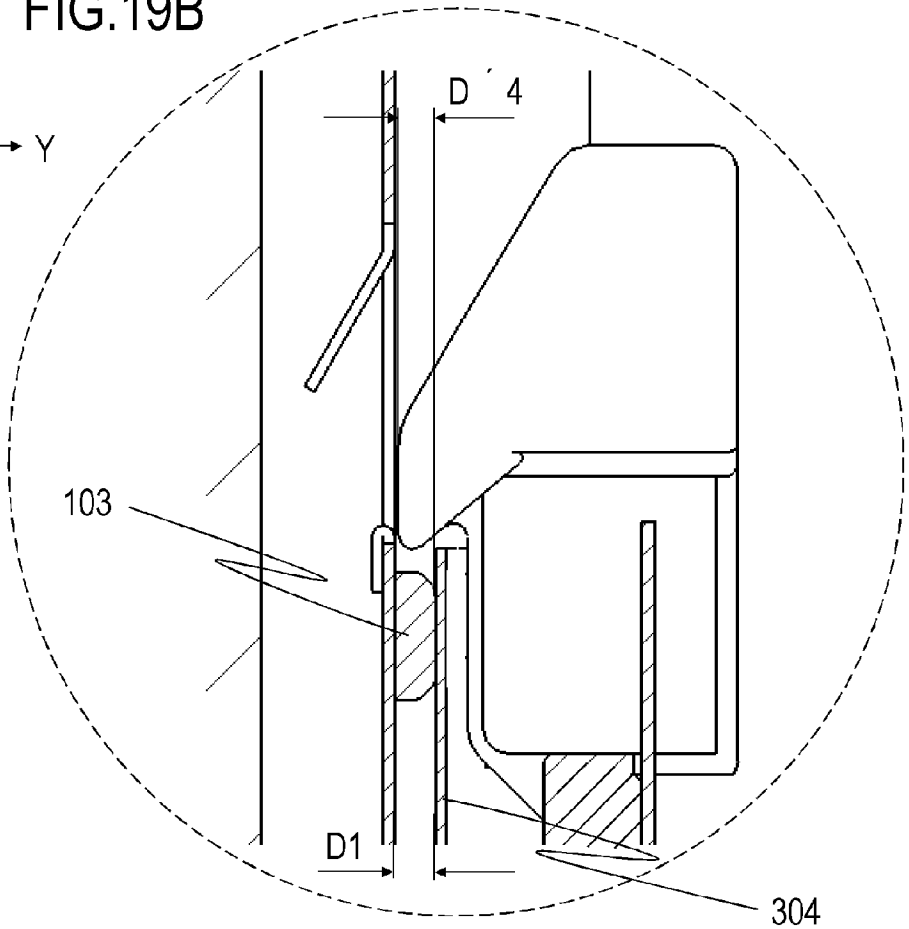
FIGS. 19A and 19B are sectional views illustrating a state in which the slide-restricted state is canceled by the user manipulation according to the second embodiment.
Figure 19A:
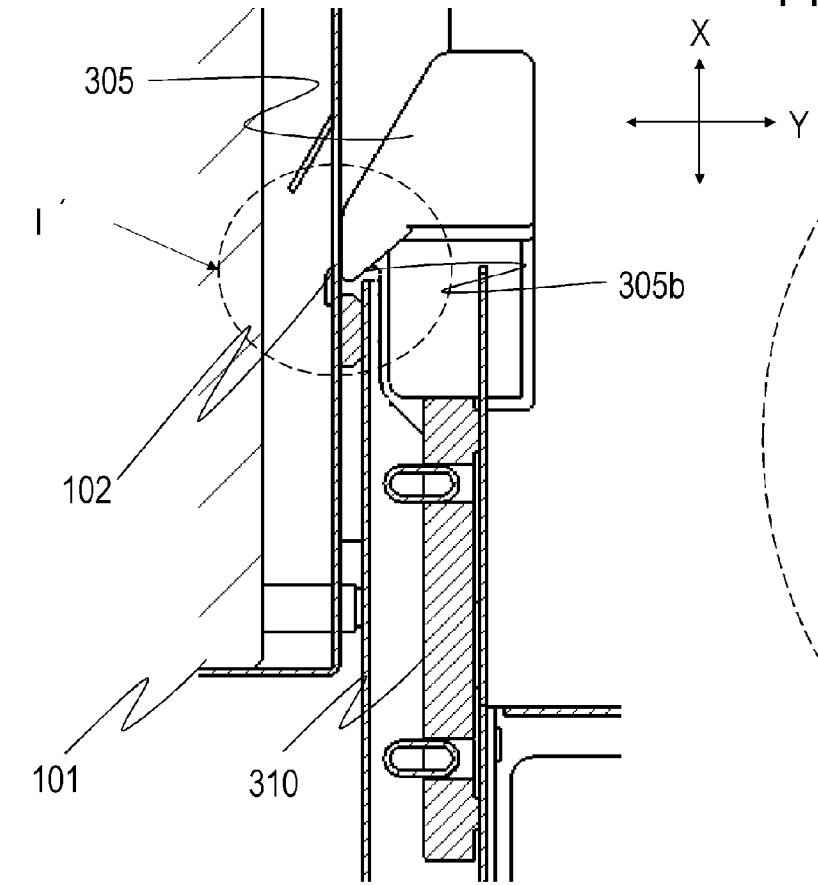

FIG. 18A is a sectional view illustrating a state in which the slide-restricted state is canceled by a user manipulation, FIG. 18B is a detailed view of an area G' shown in FIG. 18A, and FIG. 18C is a detailed view of an area H' shown in FIG. 18A. It should be noted that FIG. 18A to FIG. 18C illustrate a state in which the tray 3 is positioned at the center relative to the apparatus main body 1. FIG. 19A is a sectional view illustrating a state in which the slide-restricted state is canceled by the user manipulation, and FIG. 19B is a detailed view of an area I' shown in FIG. 19A. It should be noted that FIG. 19A and FIG. 19B illustrate a state in which the tray 3 is inclined on one side with respect to the apparatus main body 1 and the frame spacer 103 and the tray rail 304 are in contact with each other.

When the tray 3 is being slid as shown in FIG. 15A, the stopper member 305 is biased by a spring 308 as an elastic member toward the frame rail 101 as shown in FIG. 15B. It means the contact portion 305*a* of the stopper member 305 is in contact with the frame rail 101. However, as shown in FIG. 15C, a clearance D'3 is formed between the slide restriction portion 309 of the stopper member 305 and the tray frame 301.

Next, referring to FIGS. 16A to 16C, description is provided about a state in which the tray 3 has been moved in the product width direction Y by the amount of the clearance D2. On the front side of the apparatus, as shown in FIG. 16A, the frame spacer 103 and the tray rail 304 make contact with each other, to thereby restrict the position in the product width direction Y of the tray 3. On the other hand, on the rear side of the apparatus, as shown in FIG. 16B and FIG. 16C, when the stopper member 305 is applied with a force larger than a biasing force by the spring 308, the stopper member 305 slides by the amount of the clearance D'3 (see FIG. 15C), and the slide restriction portion 309 abuts the tray frame 301. At this time, the contact portion 305*a* of the stopper member 305 is protruded from the tray rail 304 by the amount of D'4.

As a result, without contact of the tray rail 304 with the frame rail 101, the stopper member 305 determines the position in the product width direction Y, which means the stopper member 305 plays a role of the spacer member. At this time, the protruding amount D'4 of the contact portion 305*a* from the tray rail 304 is set to $D1 \geq D'4$.

When the tray 3 is drawn out and moved from the sliding state to the slide restricting position as shown in FIG. 17A, the stopper member 305 provided in the tray 3 slides and moves, as shown in FIG. 17B, to the restriction portion 102 provided on the side of the tray frame 301 by the biasing force of the spring 308. As a result, the restriction portion 102 and the stopper portion 305*b* engage with each other to thereby restrict sliding of the tray 3 in the drawing-out direction (slide direction X).

As shown in FIG. 18A, when the stopper member 305 is manipulated so that the stopper member 305 moves to the cancel position for detaching the tray 3 in the slide-restricted state (see FIGS. 17A and 17B) from the apparatus main body 1, the user manipulates the manipulation portion 310 provided in the stopper member 305. The manipulation is specifically the manipulation of pushing in the manipulation portion 310 according to the second embodiment. When the manipulation portion 310 is manipulated with a force larger than a spring pressure biasing the stopper member 305, the stopper member 305 slides in the Y direction, and is manipulated, as shown in FIG. 18C, until the slide restriction portion 309 abuts the tray frame 301. In the state of FIGS.

18A to 18C, there is a clearance of D2+D1−D'4≥0 between the stopper portion 305*b* of the stopper member 305 and the frame rail 101 as shown in FIG. 18B. This enables the slide restriction to be canceled, and sliding the tray 3 in the slide direction X enables detachment of the tray 3 from the apparatus main body 1.

In practice, as shown in FIG. 19A, there is a case of performing detachment with the frame spacer 103 being in contact with the tray rail 304. Setting the protruding amount D1 and the protruding amount D'4 to be as close values as possible makes it possible to reduce backlash between the apparatus main body 1 and the tray 3. When the frame spacer 103 and the restriction portion 102 are disposed apart from each other, the tray 3 turns about the frame spacer 103. As a result, a clearance with the tray rail 304 in the vicinity of the restriction portion 102 at a distance apart from the spacer 103 becomes smaller than the protruding amount D1.

To prevent this, in the configuration according to the second embodiment, as shown in FIG. 12B, the frame spacer 103 is disposed in the vicinity of the restriction portion 102 of the frame rail 101. This configuration ensures the clearance by the frame spacer 103 regardless of the posture of the tray, and therefore the tray 3 can be detached from the apparatus main body 1.

Owing to the operation described above, in the sheet feeding apparatus according to the second embodiment, the stopper member provided on the sheet storing tray side and the spacer member can be configured by the same member (stopper member 305), and therefore costs of the apparatus can be reduced. Further, because cancellation of the slide position restriction when the sheet storing tray 3 is detached from the sheet feeding apparatus main body 1 can be performed by manipulating the stopper member 305, the sheet storing tray 3 can be detached without being lifted and therefore attachment/detachment performance is improved.

Listed below are examples of the sheet feeding apparatuses recited in the above embodiments. It should be noted that, in implementation of the present invention, it is possible to appropriately select and combine the configurations and the arrangements recited in the respective embodiments shown above within the consistent scope.

(1) A sheet feeding apparatus 100 of one aspect of the present invention includes a sheet storing tray 2 (or sheet storing tray 3) for loading sheets, an apparatus main body 1 to which the sheet storing tray 2 is slidably attached, and a restriction mechanism that restricts a position at which the sheet storing tray 2 is drawn out from the apparatus main body 1. The restriction mechanism has a restriction portion 102 as an engagement portion provided in the apparatus main body 1 and a stopper member 205 that is provided in the sheet storing tray 2 and engages with the restriction portion 102. The stopper member 205 is configured so as to move in a crossing direction (product width direction Y) crossing a slide direction X in which the sheet storing tray 2 slides and determines a position in the product width direction Y of the sheet storing tray 2 with respect to the apparatus main body 1.

With this configuration, the sheet storing tray 2 can be attached and detached by a stopper member 205 that determines the position of the sheet storing tray 2 in the product width direction Y with respect to the apparatus main body 1 while restricting the position when the sheet storing tray 2 is drawn out from the apparatus main body 1.

The stopper member 205 is configured so as to move between a slide restricting position (position shown in FIG. 10B) at which sliding in the direction of drawing out the sheet storing tray 2 from the apparatus main body 1 is restricted and an evacuation position (position shown in FIG. 12B) that allows evacuation from the state engaged with the restriction portion 102 and attachment/detachment of the sheet storing tray 2 to/from the apparatus main body 1. With this configuration, the sheet storing tray 2 can be easily detached from the apparatus main body 1 only by manipulating the stopper member 205.

The stopper member 205 is provided with a turning restriction portion 210 that restricts the amount of movement in an evacuation direction extending from the slide restricting position toward the evacuation position. This prevents the stopper member 205 from interfering with other members caused by too large amount of movement of the stopper member 205.

The stopper member 205 may be configured so as to determine the position in the product width direction Y of the sheet storing tray 2 with respect to the apparatus main body 1 at the evacuation position in which the sheet storing tray 2 is being drawn out from the apparatus main body 1. This configuration prevents backlash when the sheet storing tray 2 is drawn out from the apparatus main body 1.

The sheet storing tray 2 has a tray positioning portion 211 for determining a position relative to the apparatus main body 1 when stored in the apparatus main body 1. The tray positioning portion 211 is a member different from the stopper member 205. This configuration allows a plurality of members to take a role of positioning of the sheet storing tray 2 with respect to the apparatus main body 1 while the sheet storing tray 2 is sliding from the state of being stored in the apparatus main body 1 to the drawn-out state. For example, the stopper member 205 may be apart from the apparatus main body 1 when the sheet storing tray 2 is stored in the apparatus main body 1.

The apparatus main body 1 has a frame spacer 103 as a protruded portion that restricts the position in the product width direction Y of the sheet storing tray 2 relative to the apparatus main body 1. The frame spacer 103 is provided in the vicinity of the restriction portion 102. This configuration prevents the sheet storing tray 2 from easily turning about the frame spacer 103.

The frame spacer 103 is provided further on the side of the direction of drawing out the sheet storing tray 2 than the stopper member 205. In other words, the stopper member 205 is provided on the deep side of the apparatus main body 1 and the frame spacer 103 is provided on the front side of the apparatus main body 1.

The sheet feeding apparatus 100 has a spring 207 for biasing the stopper member 205 in the product width direction Y against the apparatus main body 1. As a result, a force of moving the stopper member 205 in the product width direction Y with respect to the apparatus main body 1 can be constantly generated with simple configuration.

The apparatus main body 1 has a frame rail 101 as a guiding member with which the stopper member 205 comes into contact when the sheet storing tray 2 is drawn out. Further, the restriction portion 102 is an opening formed in the frame rail 101.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-054545, filed on Mar. 25, 2020, which is hereby incorporated by reference herein in its entirety.

What is claimed is:

1. A sheet feeding apparatus comprising:

a sheet storing tray for loading sheets;

an apparatus main body to which the sheet storing tray is slidably attached;

an engagement portion provided in the apparatus main body; and a stopper member that is provided in the sheet storing tray and configured to engage with the engagement portion to restrict movement of the sheet storing tray in a direction in which the sheet storing tray slides wherein the stopper member is configured so as to be movable in a crossing direction that crosses the direction in which the sheet storing tray slides and determines a position in the crossing direction of the sheet storing tray with respect to the apparatus main body, and wherein the stopper member is apart from the apparatus main body when the sheet storing tray is stored in the apparatus main body.

2. The sheet feeding apparatus according to claim 1, wherein the stopper member is configured so as to be movable between a slide restricting position that restricts sliding in a direction of drawing out the sheet storing tray from the apparatus main body and an evacuation position that allows evacuation from a state of being engaged with the engagement portion and attachment/detachment of the sheet storing tray to/from the apparatus main body.

3. The sheet feeding apparatus according to claim 2, wherein the stopper member is provided with a restriction portion that restricts an amount of movement in an evacuation direction extending from the slide restricting position toward the evacuation position.

4. The sheet feeding apparatus according to claim 2, wherein the stopper member is configured so as to determine a position in the crossing direction of the sheet storing tray with respect to the apparatus main body at the evacuation position in a state in which the sheet storing tray is being drawn out from the apparatus main body.

5. The sheet feeding apparatus according to claim 1, wherein the sheet storing tray has a positioning member for determining a position with respect to the apparatus main body when the sheet storing tray is stored in the apparatus main body, and wherein the positioning member is a member different from the stopper member.

6. The sheet feeding apparatus according to claim 1, wherein the apparatus main body has a protruded portion that restricts the position in the crossing direction of the sheet storing tray with respect to the apparatus main body, and wherein the protruded portion is provided in a vicinity of the engagement portion.

7. The sheet feeding apparatus according to claim 6, wherein the protruded portion is provided further in a direction of drawing out the sheet storing tray than the engagement portion.

8. The sheet feeding apparatus according to claim 1, further comprising an elastic member for biasing the stopper member in the crossing direction with respect to the apparatus main body.

9. The sheet feeding apparatus according to claim 1, wherein the apparatus main body has a guiding member with which the stopper member comes into contact when the sheet storing tray is drawn out, and wherein the engagement portion is provided in the guiding member.

* * * * *